US006550646B1

(12) United States Patent
Takahara et al.

(10) Patent No.: US 6,550,646 B1
(45) Date of Patent: Apr. 22, 2003

(54) SYNTHETIC RESIN-MADE TUBULAR CONTAINER

(75) Inventors: Kazuo Takahara, Fujioka (JP); Takao Kishi, Koto-ku (JP); Shigeo Iizuka, Koto-ku (JP); Tatsuharu Ida, Fujioka (JP); Kazuaki Nose, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/719,212

(22) PCT Filed: May 31, 2000

(86) PCT No.: PCT/JP00/03519

§ 371 (c)(1),
(2), (4) Date: Jan. 22, 2001

(87) PCT Pub. No.: WO00/73165

PCT Pub. Date: Dec. 7, 2000

(30) Foreign Application Priority Data

| | | |
|---|---|---|
| May 31, 1999 | (JP) | 11-152366 |
| Oct. 27, 1999 | (JP) | 11-305551 |
| Oct. 29, 1999 | (JP) | 11-309067 |
| Nov. 30, 1999 | (JP) | 11-339742 |
| Nov. 30, 1999 | (JP) | 11-340147 |
| Nov. 30, 1999 | (JP) | 11-340384 |

(51) Int. Cl.[7] ..... B65D 47/36; B65D 35/44

(52) U.S. Cl. ..... 222/107; 222/541.9; 222/546; 222/556; 220/270

(58) Field of Search ..... 222/107, 212, 222/541.6, 541, 546, 556; 220/258, 270, 837; 215/235

(56) References Cited

U.S. PATENT DOCUMENTS

| | | | | |
|---|---|---|---|---|
| 3,610,484 A | * | 10/1971 | Matzka | 222/541.9 |
| 4,355,729 A | | 10/1982 | Maguire | |
| 4,377,248 A | * | 3/1983 | Stull | 222/546 |
| 4,966,301 A | * | 10/1990 | Yamashita et al. | 220/270 |
| 5,769,277 A | * | 6/1998 | Elliott | 220/270 |
| 5,810,207 A | * | 9/1998 | Hayashida | 222/562 |
| 5,992,659 A | * | 11/1999 | Nofer et al. | 222/556 |
| 6,116,477 A | * | 9/2000 | Kreiseder et al. | 222/556 |
| 6,234,334 B1 | * | 5/2001 | Suarez | 222/541.6 |
| 6,283,317 B1 | * | 9/2001 | Benoit-gonin et al. | 222/541.6 |
| 2002/0014501 A1 | * | 2/2002 | Nyman et al. | 222/546 |

FOREIGN PATENT DOCUMENTS

| | | |
|---|---|---|
| JP | 41-19660 | 5/1965 |
| JP | 1-103542 | 7/1989 |
| JP | 4-121262 | 10/1992 |
| JP | 04-121262 | 10/1992 |
| JP | 7-13751 | 3/1995 |
| JP | 7-187213 | 7/1995 |
| JP | 08-026309 | 1/1996 |
| TW | 314867 | 9/1997 |
| WO | 2642400 | 8/1999 |

* cited by examiner

*Primary Examiner*—Kenneth Bomberg
(74) *Attorney, Agent, or Firm*—Oliff & Berridge, PLC

(57) ABSTRACT

A container including a tube member having a truck portion which is elastically squeezable, and a wide-mouthed neck portion extending upwardly from the trunk portion, a top wall closing a top surface of the neck portion and having a discharge port, said top wall also having a peripheral portion connected to a top end of the neck portion, from which the peripheral portion is made undetachably, and a cover plate connected by a hinge to the neck portion and having a plug for closing the discharge port, the plug depending from an underside of the cover plate, wherein the top wall has a first breaking line which is formed within the peripheral portion of the top wall, and a knob for tearing the first breaking line, said knob is formed on the top wall within the first breaking line.

15 Claims, 27 Drawing Sheets

SYNTHETIC RESIN-MADE TUBULAR CONTAINER

BACKGROUND OF INVENTION

1. Field of the Invention

Present invention relates to a synthetic resin made tube container.

2. Description of the Invention

As this type of container, there is widely used a container generally consisting of a tube member having a thin-walled trunk portion, from the upper end of which a neck portion with a relatively small diameter is erecting through a shoulder; and of a cap member having a fitting cylinder which is screwed on the outside of the neck portion, the top face of the fitting cylinder being closed by a top wall with a discharge port, while at the circumference of the top wall, a cover plate is connected rotationally between an upright position and a lateral position through a thin hinge.

In this container, however, for fixing the cap member on the neck portion firmly, the neck portion and the fitting cylinder should have a certain longitudinal length for forming necessary numbers of screw ridges for providing mutual engagements on the outside of the neck portion and the inside of the fitting cylinder. Naturally, the length of neck portion and the fitting cylinder become longer, and this requires more material to be used for forming the container.

For solving this problem, the present applicant proposes several types of containers, each of which is constructed to shorten the length from the upper end of the trunk portion to the top face of the cap member including the neck portion. One of them has a top wall with a discharge port, the circumference of the top wall merging into the neck portion of the tube member, and a cover plate which is connected to the neck portion via a connecting member such as a fixing cylinder fitted on the neck portion. Another type of them comprises a cap member which consists of a top wall with a discharge port, a circumferential wall depending form the top wall so as to be fitted firmly on the outside of the neck portion, and a cover plate which is connected to the top wall through a hinge.

However, in the aforementioned containers, the top wall with the discharge port is formed integrally with the neck portion by merging the circumference of the top wall to the top of the neck portion. Otherwise, the top wall is connected to the neck portion in a way it is difficult to depart the top wall from the neck portion. These features make it difficult for users to make full use of the contents in the container. Namely, when the quantity of the contents is running small, the remainder of the contents usually gathers in the container's shoulder portion which has a large rigidity against squeezing. As a result, a large physical force is required for pressing out the remainder, even if it could. Although, in the tube container preliminary mentioned having the top-closed fitting cylinder screwed on the neck portion, it is possible to detach the fitting cylinder together with the top wall and to take out the remainder, however it is impossible to detach the top wall in the container in which the top wall is integrally connected to the neck portion, and also it is difficult to detach it in the container in which the circumferential wall depending from the top wall is firmly fixed on the outside of the neck portion.

To solve such a problem, an useful tube container having a means for removing the top wall when its contents is running short, is desired.

Referring to a prior art which relates to this issue, for example, Japanese Utility model Laid-Open No. 4 (1992) 121262 shows a cap having a fitting peripheral wall for fitting on the neck portion of the container and a top wall for covering the upper face of the fitting peripheral wall, said top wall having a center portion which is depressed to form a recessed cylinder with a bottom. The recessed cylinder has a removable plate portion defined within a breaking line which is formed at a periphery of the bottom, a support member standing from a rear part of the removable plate portion, and a ring-shaped handle which is protruded forward from the top of the supporting member for tearing off the breaking line. In the prior art, however, said handle is used by pulling at the beginning of the use of the container to remove the removable plate portion so as to open the container. Therefore, there is no idea to provide means for removing the top wall to take out the small quantity of the contents remained in the container, especially without being a hindrance for a normal operation from the beginning of the use of the container to the removal of the top wall, for example an operation for distributing a liquid from a discharge orifice.

SUMMARY OF THE INVENTION

The primary purpose of the invention is to make it easy to take out the remainder of the contents in the container when the quantity of the contents is small. For this purpose, there is proposed a tube container with a top wall connected undetachably to the top end of the neck portion, wherein the container further has a separation part such as a breaking line for departing the top wall, and a knob or a belt for tearing off the separation part.

The second purpose of the invention is to assure a comfortable use in a usual service period from the beginning of its use until removing the top wall. For this purpose, there is proposed a tube container in which the knob or the belt is mounted in a way that it does not disturb the ordinary use.

The third purpose of the invention is to facilitate tearing off the breaking line. For this purpose, there is proposed a combination of a plurality of breaking lines, or a breaking line defined by an interface in which two different type of the synthetic resin meet together.

DETAILED DESCRIPTION OF PREFERRED EMBODIMENTS

Figure 1:
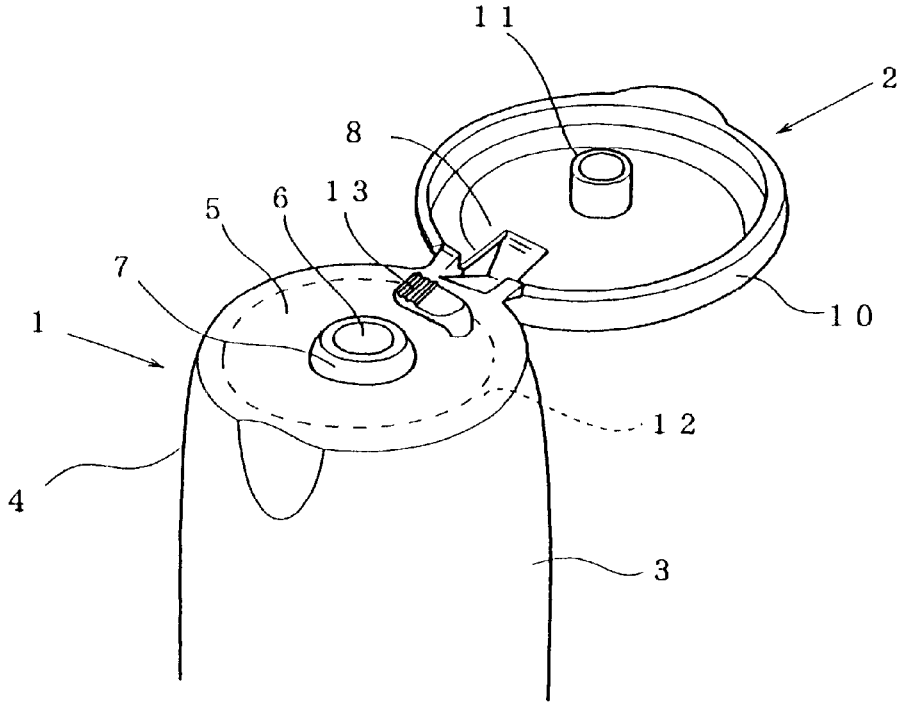
FIG. 1 is a perspective view of the container in the first embodiment of the present invention.
Figure 2:
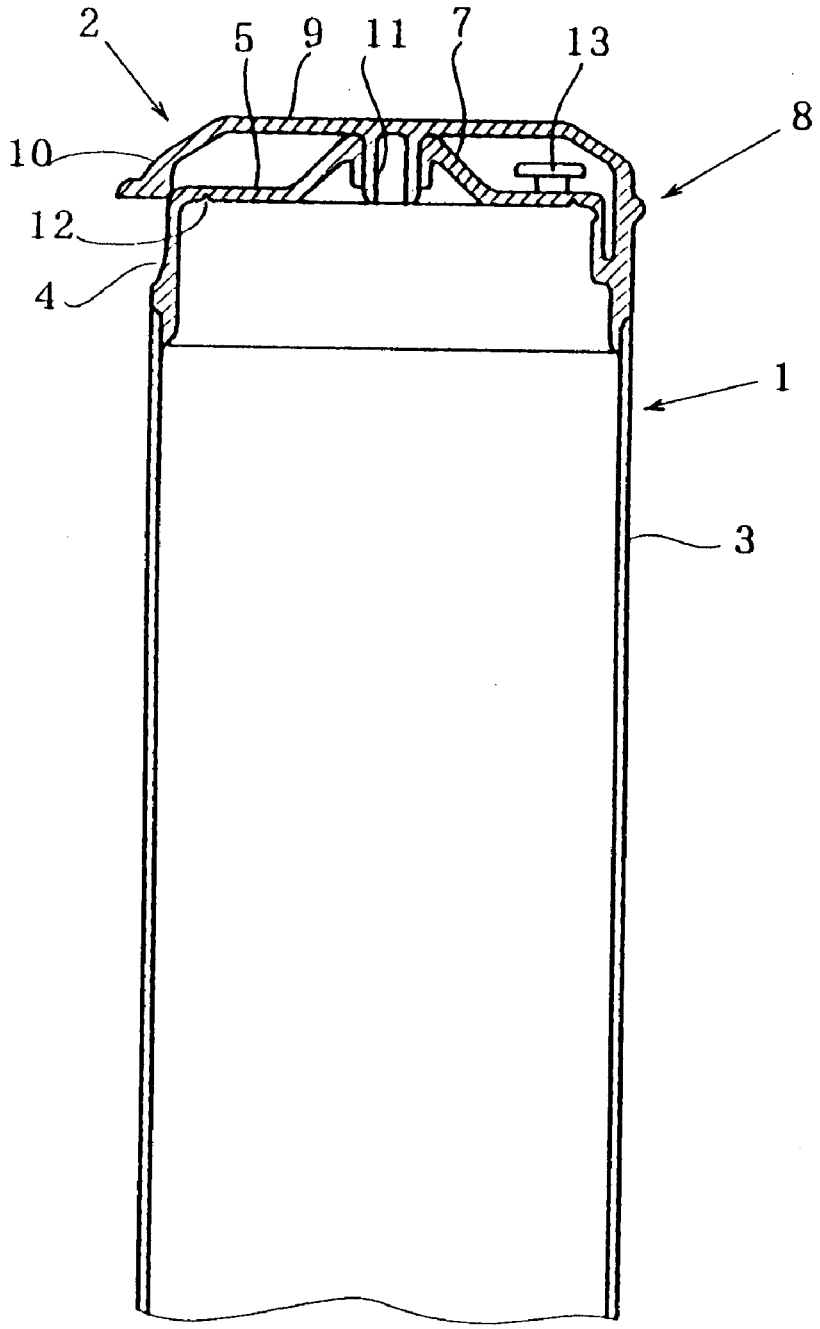
FIG. 2 is a vertical sectional view of the container shown in FIG. 1.
Figure 3:
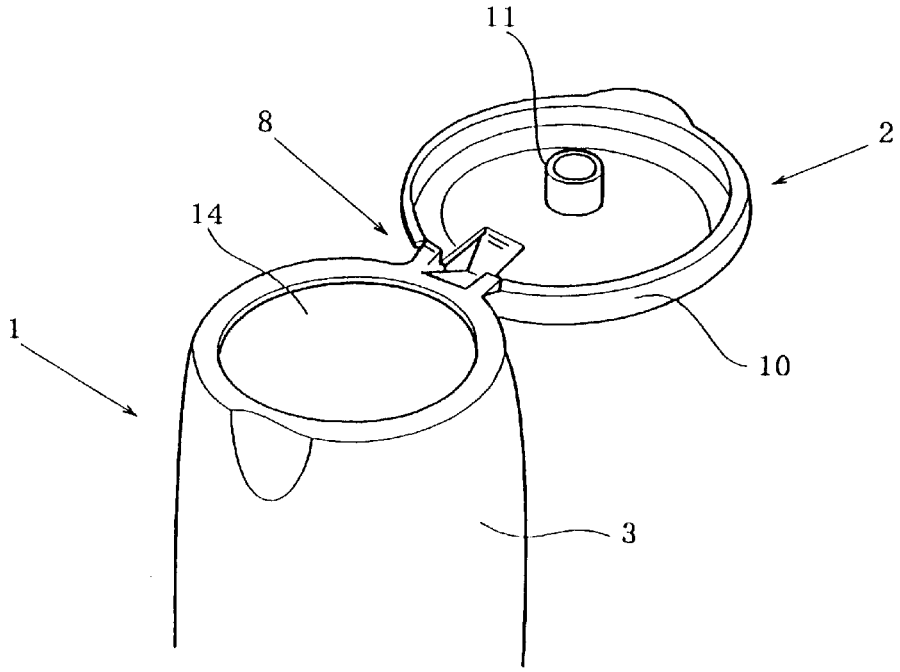
FIG. 3 is a perspective view of the container in the shown in FIG. 1 in a state in which a cover is opened and a top wall is removed.

FIGS. 1 to 3 shows a tube container in first embodiment of the present invention.

In this embodiment, the container comprises a tube member 1 to which a cap member 2 is connected integrally. The tube member 1 and the cap member 2 are made of synthetic resin respectively.

The tube member 1 has an elastically squeezable, trunk portion 3 having an open top.

The cap member 2 has a wide-mouthed (i.e. large diameter) neck portion 4, a diameter of which is generally equal to that of the trunk portion 3, with the lower end of the neck portion 4 being formed to merge into the upper end portion of the trunk portion 3 by means of a supersonic welding, or a compression molding etc. The cap member 2 also has a top wall 5 for closing the upper surface of the neck portion 4 and opening a discharge port 6 in a nozzle cylinder 7 formed in the center of the top wall 5, and a cover plate 9 which is connected to a portion (a rear portion, in this shown embodiment), of the circumference of the top wall 5 via a three-point hinge member 8. A short circumferential cap wall 10 is depending from the circumference of the cover plate 9. A plug 11 for inserting into the discharge port 6 is depending from the underside of the cover plate 9.

A first breaking line (or fragile line) 12 is formed circumferentially in the peripheral portion of the top wall 5, spaced apart a constant interval from the outer ridge of said top wall. The first breaking line 12 is defined by a thin breaking line, i.e. a line which is formed fragile by diminishing the thickness of the top wall 5. At the inside of the first breaking line 12, a L-shaped knob 13 is protruding from the top wall 5 and fallen sideways, such that the the breaking line may be torn off by pulling up the knob. In the shown embodiment, the knob is provided in the vicinity of the breaking line 12 therewithin, such that the pulling force is effectively transmitted to the breaking line.

The knob 13 may be provided apart from a front portion of the top wall (i.e. a portion of the top wall contrary to the hinge member), or more preferably in the neighborhood of the hinge member on the top wall 5. In this specification, the words "front" and "back", and "right" and "left" are used to describe the relative location of the components of the container.

In the aforementioned construction, the container is usually used by opening the cover plate 9 as shown in FIG. 1, inclining the tube member 1 in a way that the cover plate 9 is located upwardly, and squeezing the trunk portion 3 so as to pour the contents from the nozzle cylinder 7 on a palm for example. At this time, the knob 13 is located in the neighborhood of the hinge, i.e. the upper backwards of the nozzle cylinder, such that discharging the contents from the nozzle cylinder to the lower front thereof (i.e. on the palm ) is not disturbed by the knob 13.

When the contents are running low, the knob 13 is to be pulled up, so that the first breaking line 12 is broken from the vicinity of the knob, and a top wall portion within the first breaking line 12 is removed to open a large diameter outlet hole 14. After that, a desired amount of the contents can be taken out by inserting the finger of the user or a pallet for example into the outlet hole. When the contents are still remained after taking out, it is possible to recap the cover plate 9 again to preserve the contents without being dried.

The other embodiments of the present invention are explained hereinafter. For avoiding an overlapping on explanations, elements corresponding to those in the first embodiments are identified by the same numeral.

Figure 4:
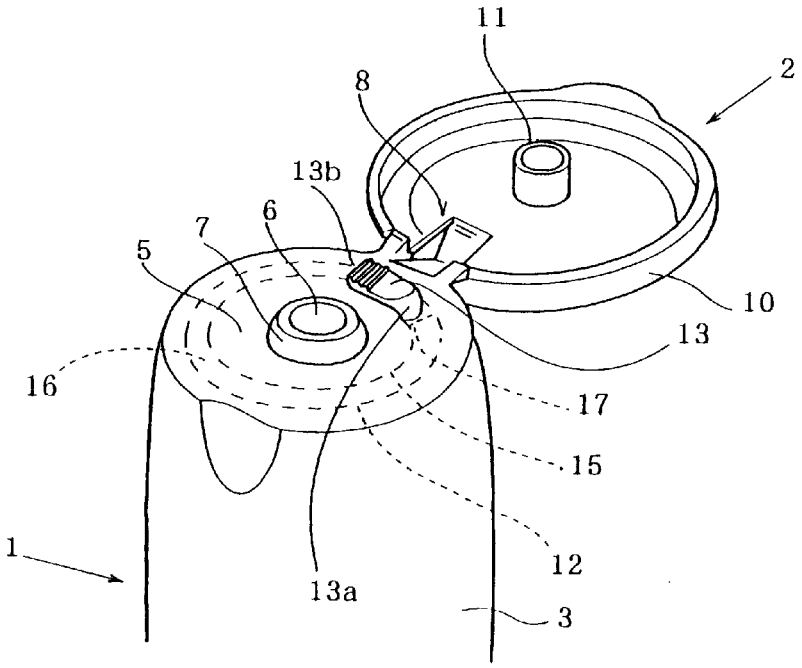
FIG. 4 is a perspective view of the container in the second embodiment of the present invention.
Figure 5:
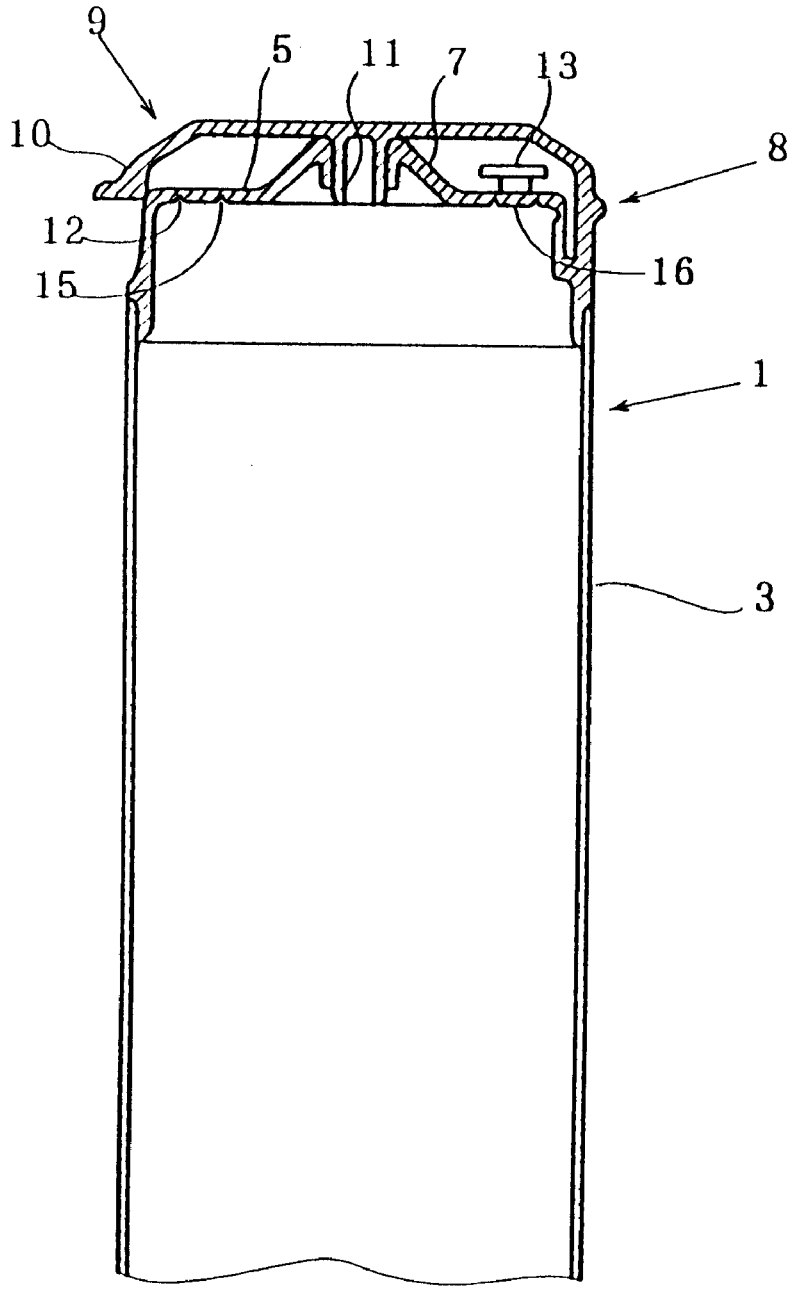
FIG. 5 is a vertical sectional view of the container shown in FIG. 4 with a cover being closed.

FIGS. 4 and 5 show the second embodiment of the present invention.

In this embodiment, a thin, second breaking line is circumferentially formed within the first breaking line 12, spacing a small constant interval therefrom. A removable zone 16 is defined by a portion of the top wall 5 between the first and second breaking lines. The knob 13 having the L-shape fallen sideways is provided on a suitable place of the removable zone 16. The zone is also provided, in the vicinity of the knob 13, with a thin, third breaking line 17 connecting the first and second breaking lines. In this construction, when pulling up the knob 13, the pulling force is largely concentrated on the first and second breaking lines on the both sides of the knob 13 and the third breaking line 17, at which a fracture begins with ease, such that the maximum pulling force at a breaking point is decreased. After the fracture begins, at least the first breaking line 12 located outside continues to break, such that the top wall is removed except its periphery portion and the large-diameter outlet port 14 is opened.

In the shown embodiment, the knob 13 has a vertical base portion 13*a* from which a horizontal leading portion 13*b* is extending into a circumferential direction contrary to the third breaking line 17 as shown in FIG. 4. In this way, the pulling force acts effectively on the third breaking line by pulling the leading portion 13*b* into the aforementioned circumferential direction. The width of the removable zone 16 may be generally the same to the corresponding width of the vertical base portion 13*a* as shown, such that the length of the third breaking line may become minimum. This means that the pulling force is concentrated on a shorter range to facilitate the action of tearing off the breaking lines.

Figure 6:
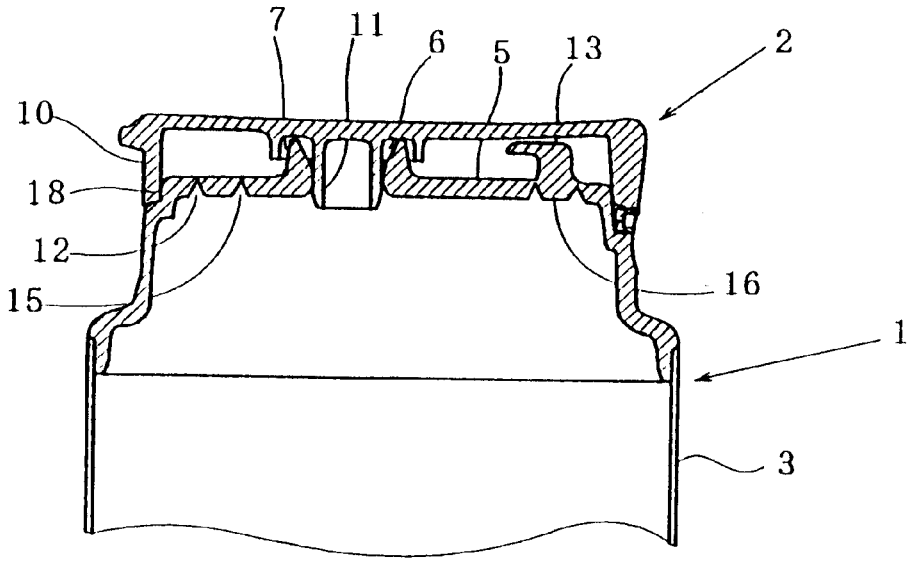
FIG. 6 is a vertical sectional view of the container in the third embodiment of the present invention.
Figure 7:
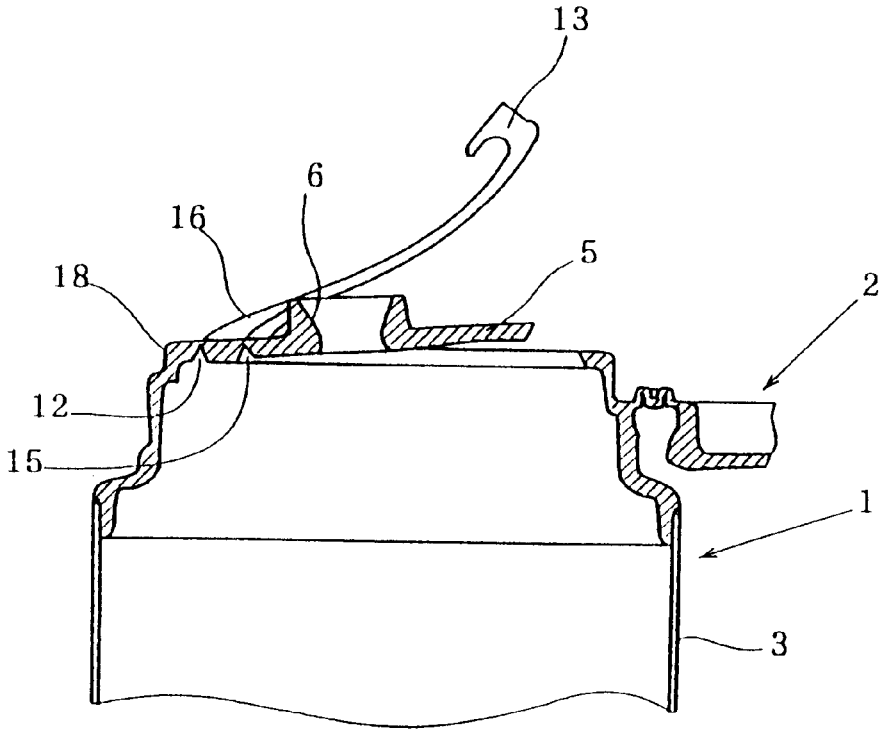
FIG. 7 is an explanation view for removing the top wall of the container shown in FIG. 6.
Figure 8:
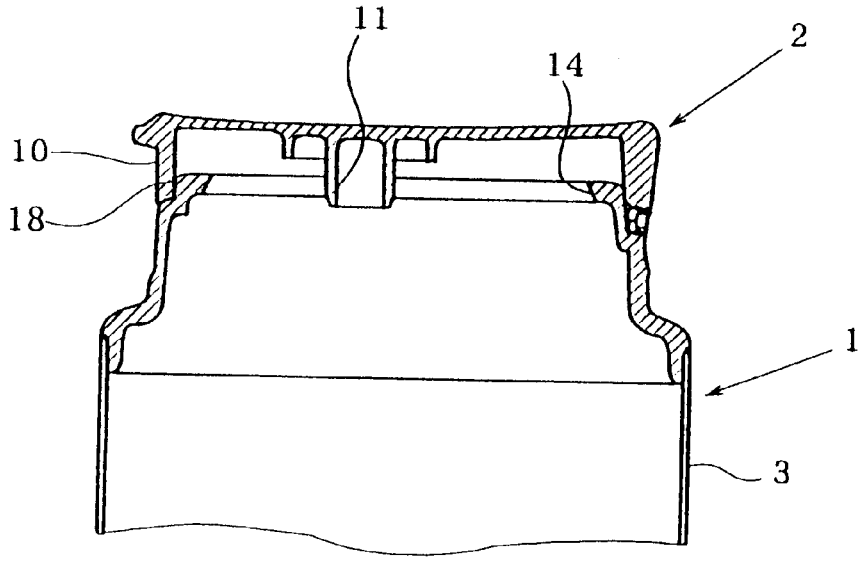
FIG. 8 is a view of the container shown in FIG. 6 after the top wall is removed.
Figure 9:
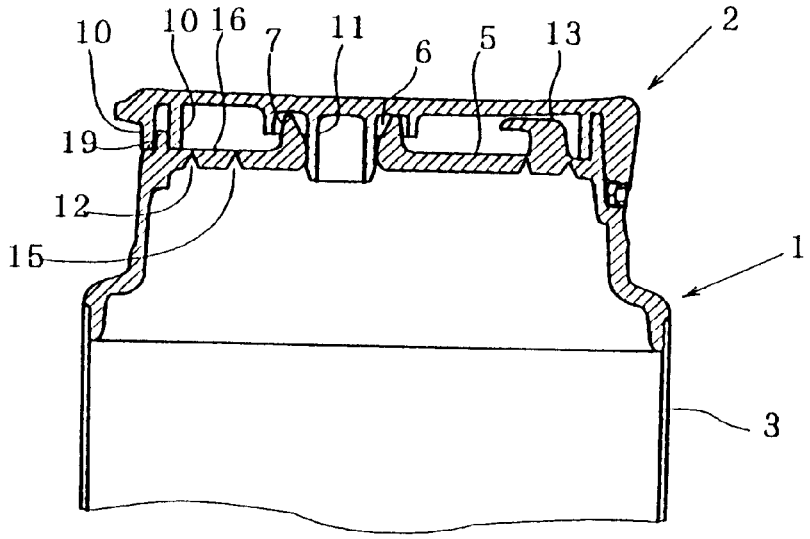
FIG. 9 is a view of a modified example of the container shown in FIG. 6.

FIGS. 6 to 9 shows a third embodiment of the present invention. In FIGS. 6 to 8, a circumferential cap wall 10 is depending from the circumference of the cover plate 9, and fitted on a small external diameter portion 18 which is formed on the upper end portion of the neck portion 4 for preventing the leakage of the liquid. The other elements of the present embodiment are fundamentally the same to those of the second embodiment. FIG. 9 shows a modified example of the present embodiment, in which a double, circumferential cap walls 10, 10 are depending from the outer circumference of the cover plate, while a rising cylinder 19 erected from the circumference of the upper side of the top wall 5 is inserted liquid-tightly into the double cap walls instead of the small outer diameter portion.

Figure 10:
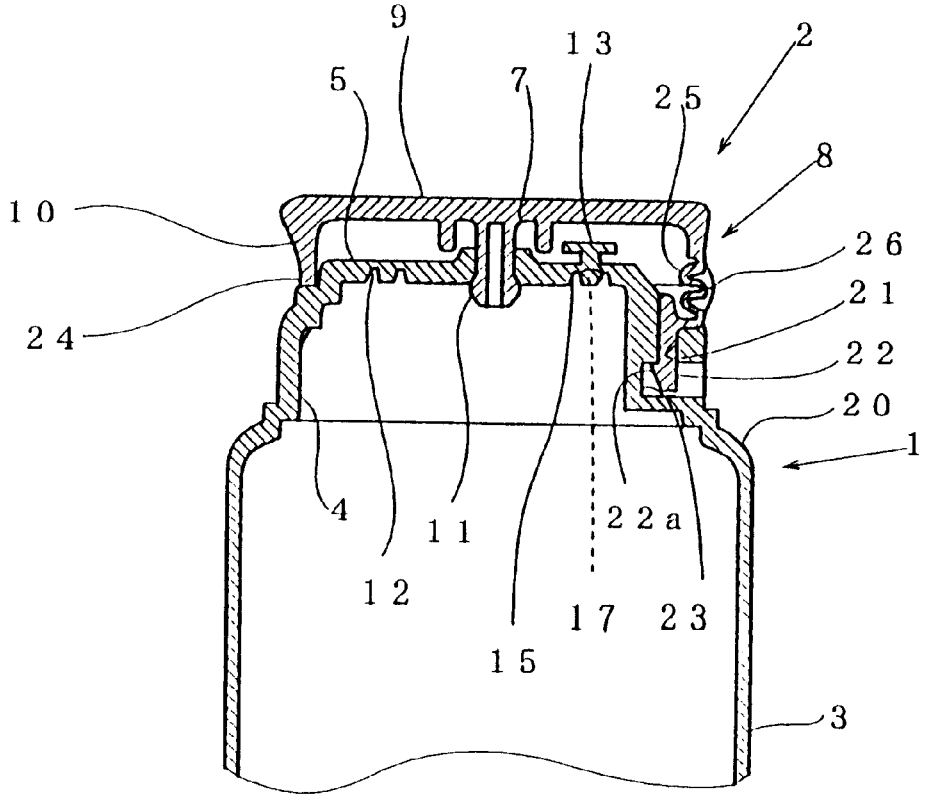
FIG. 10 is a vertical sectional view of the container in the fourth embodiment of the present invention.
Figure 11:
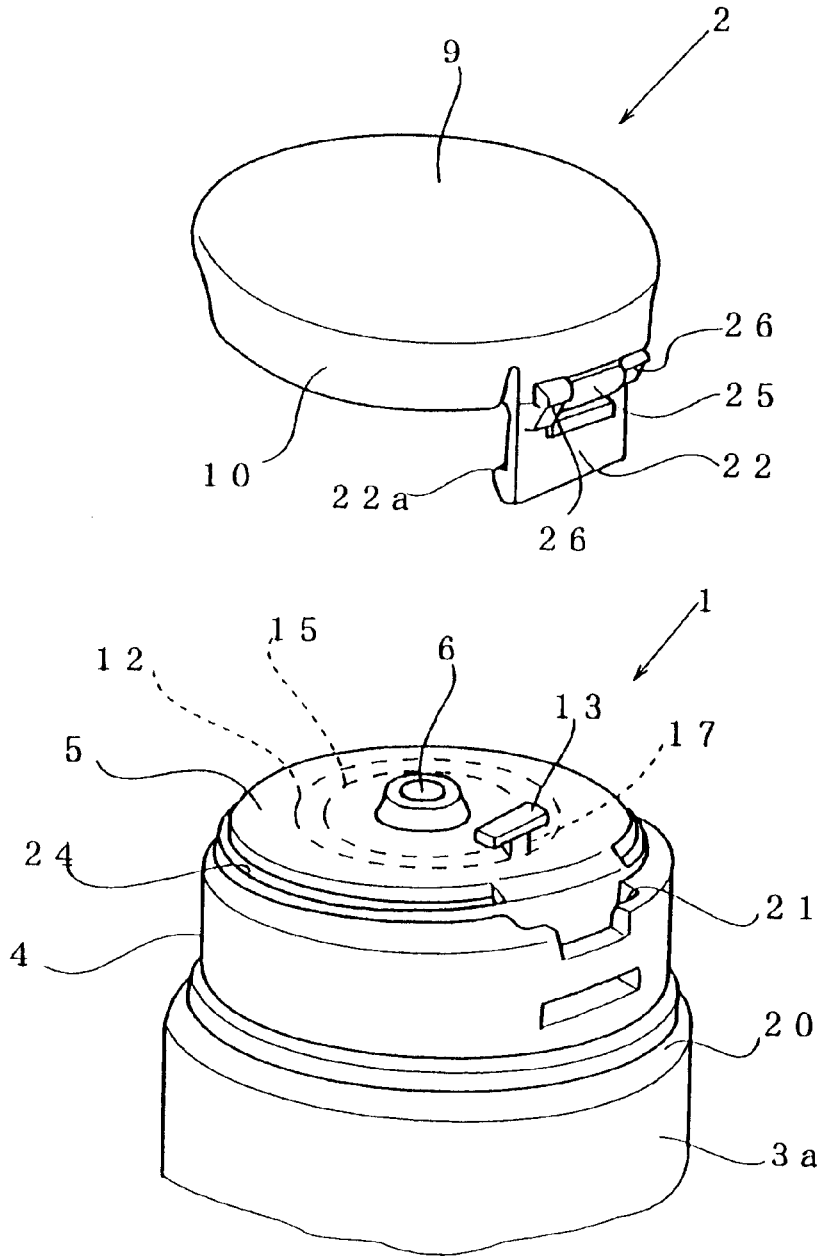
FIG. 11 is a perspective view of the container shown in FIG. 10 in a resolved state.

FIGS. 10 and 11 show the fourth embodiment of the present invention.

In this embodiment, the container comprises a tube member 1 which is integrally formed to have a trunk portion 3 and a top-closed neck portion 4 erecting from the upper end of the trunk portion. The neck portion 4 has an outer circumferential portion, the back of which is recessed at its upside to form a fitting hole 21. And a flat thrusting plate 22 for inserting into the fitting hole, is depending from the back of the cover plate 9 at a circumference thereof.

In a shown embodiment, the back of the neck portion is formed into a flat portion parallel to a tangent line extending into the left and the right, and the fitting hole 21 is formed on the flat portion. The fitting hole 21 has an indent 23 for providing an engagement with a later-described engagement ridge of the thrusting plate 22, said recess extending forward from the lower end of the fitting hole 21, such that the fitting hole has a L-shaped cross section. Meanwhile, the top wall 5 is provided with a fitting recess 24 at the ridge of its upper surface except the rear portion of the top wall.

A cap member 2 has a circumferential cap wall 10 depending from the circumference of the cover plate 9 and an elastic plate 25 meandering in a zigzag in its cross sectional view, through which the thrusting plate 22 is depending from the back of the circumferential cap wall 10. On the both left and right sides of the elastic plate 25, it is preferable that a pair of thin hinges 26 connect the circumferential cap wall with the left and right upper end portions of the thrusting plate 22. At the lower end of the thrusting plate, there is protruding forward an engagement ridge 22a which is engaged into the indent 23.

The top wall 5 comprises, as it does in the second embodiment, the first breaking line 12, the second breaking line 15, the third breaking line 17, and the removable zone 16 which is formed between the first and second breaking lines, while a T-shaped knob 13 is formed on the upper side of the removable zone 16 in the vicinity of the third breaking line.

According to the construction in this embodiment, the tube member and the cap member are constructed separately, such that it is possible to select the type of the resin suitable for forming each member. For example, a relatively soft resin may be preferably chosen for the tube member for facilitating the fracture and removal of the top wall. On the other hand, a relatively rigid resin may be preferably chosen for the cap member having the elastic plate.

Furthermore, by preparing several types of tube members and the cap members having different color or different outside printing designs, it is possible to meet with a requirement for providing a large kinds of containers with a little quantity in accordance with an increase in the variety of the contents.

Figure 12:
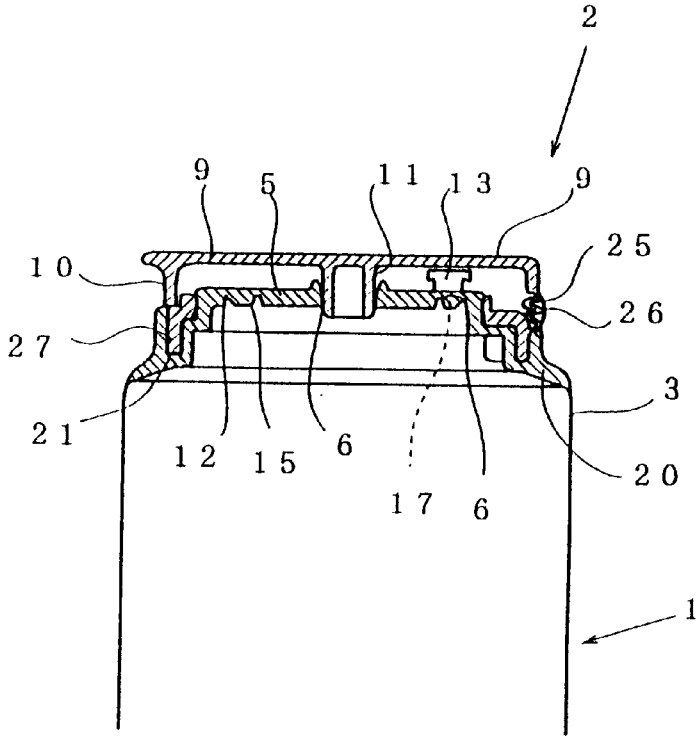
FIG. 12 is a vertical sectional view of the container in the fifth embodiment of the present invention.
Figure 13:
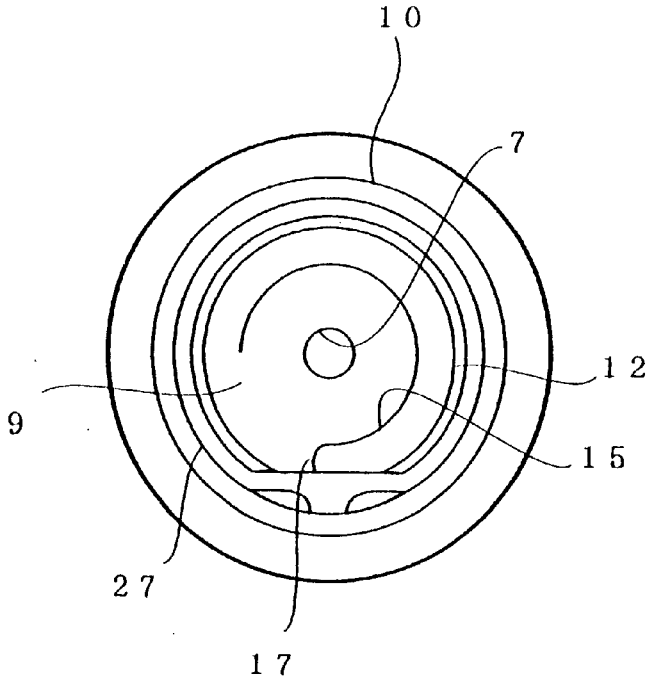
FIG. 13 is a bottom view of the cover of the container shown in FIG. 12.

FIGS. 12 and 13 show the fifth embodiment of the present invention, in which the thrusting plate in the fourth embodiment is modified into an annular shape. Namely, an annular fitting hole 21 is formed on the circumference of the neck portion 4, while an annular thrusting plate 27, which is connected to the lower end of the circumferential cap wall 10 at a favorable portion thereof through the thin hinge 26, is inserted into the annular fitting hole 21. The other parts of its construction are generally the same to those in the fifth embodiment. The annular thrusting plate 27 may be fitted and then welded to the inner face of the fitting hole. The shown fitting hole 21 has a generally circular cylindrical shape with a flat rear portion which is parallel to a tangent thereat. Furthermore, the fitting hole continues to a stepped portion formed on an upper inner circumference of the fitting hole. The annular thrusting plate 27 has a lower end portion fitted into the annular fitting hole, and a small diameter upper portion which is erecting from the lower end portion through another step extended on the step portion.

FIGS. 14 to 19 show the sixth embodiment of the present invention.

The container according to this embodiment is different from those in the first to fifth embodiments in that it has a top wall 5 for closing the neck portion, said top wall being incorporated into the cap member 2, separately from the tube member 1. The tube member 1 is integrally formed so as to have a wide-mouthed (i.e. large-diameter) neck portion 4 erecting from the trunk portion 3 through a shoulder 20. While the cap member 2 is integrally formed so as to have a first circumferential wall 28 which is depending from the underside of the top wall 5 above the neck portion 4 and fitted firmly on the outside of the neck portion, an auxiliary circumferential wall 29 depending from the outer edge of the top wall, and a second circumferential wall 30 depending from the circumference of the cover plate 9 and being connected to the rear portion of the auxiliary circumferential wall through the thin hinge 26.

Figure 16:
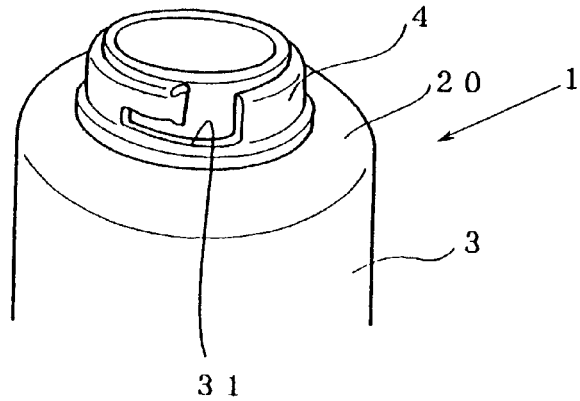
FIG. 16 is a perspective view of the part of the container shown in FIG. 14.

As shown in FIG. 16, the neck portion is provided at the outside thereof with a recessed groove 31 having a L-shape fallen sideways as a part of cap member fixing means.

Figure 14:
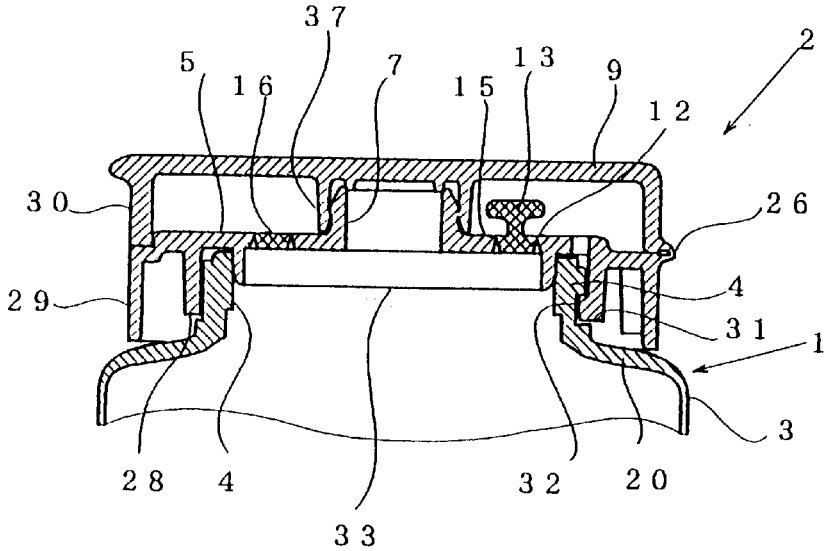
FIG. 14 is a vertical sectional view of the container in the sixth embodiment of the present invention.

In the cap member, on the other hand, the first circumferential wall 28 is provided at the lower inside portion of its back with an engagement projection 32 for preventing the cap member from slipping out as shown in FIG. 14. The engagement projection 32 is formed to be fitted into the leading end portion of the recessed groove by pressing into the recessed groove from above and turned therein, such that the cap member is fitted on or firmly fixed to the outside of the neck portion. In the shown embodiment, moreover, a first sealing cylinder 33 for sealing the inside of the neck portion 4 is depending from the portion of the top wall within the first circumferential wall 28, and a second sealing cylinder 37 for fitting onto the outside of the nozzle cylinder 7 is depending from the central portion of the underside of the cover plate.

Figure 15:
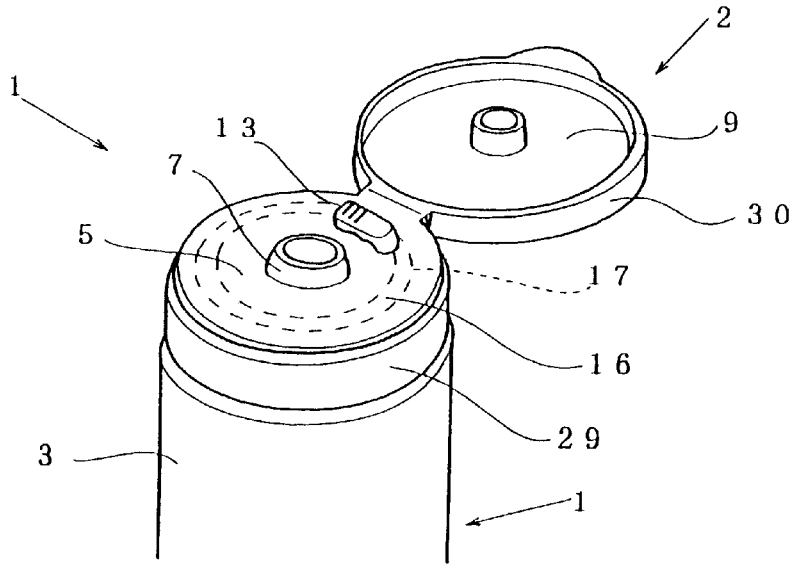
FIG. 15 is a perspective view of the container shown in FIG. 14 with a cover being opened.
Figure 18:
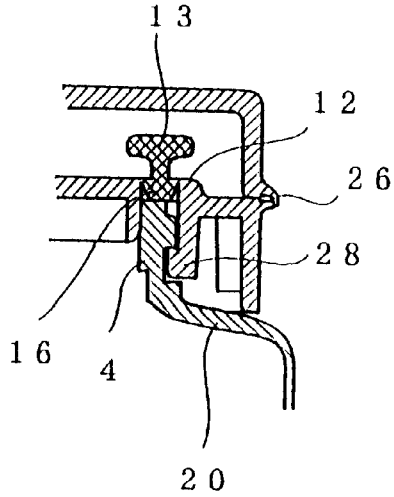
FIG. 18 is the view of the modified example of another part of the container shown in FIG. 14.

In the present invention, three breaking lines 12, 15, 17 shown in FIGS. 14 and 15 are provided in the top wall as they are in the second embodiment. Namely, the first and second breaking lines 12 and 15 are formed circumferentially on the top wall portion within the neck portion 4, defining a double circle encircling the nozzle cylinder 7 and spacing a constant interval between respective circles. And moreover, the portion of the top wall between the first and second breaking lines is formed into the removable zone 16 on which the knob 13 is attached, and the third breaking line 17 for connecting the first and second breaking lines is provided on the removable zone 16 in the vicinity of the knob 13. In this embodiment, on the other hand, the removable zone 16 is made of one type of synthetic resin which differs from that of the other part of the top wall. Each of the first and second breaking lines is defined as an interface in which the two type of synthetic resin meet each other. The third breaking line may be formed as a thin breaking line. In the shown embodiment, the first breaking line 12 is formed circumferentially within the neck portion. However, the first breaking line may be formed outside the neck portion as shown in FIG. 18, or it may be formed above the neck portion although it is not shown in the drawings. The cap member 2 in the present invention may be integrally formed, including the removable zone and the knob made of different type of material, by means of an insert formation for example. The two type of different synthetic resins may be different material having different colors.

Figure 17:
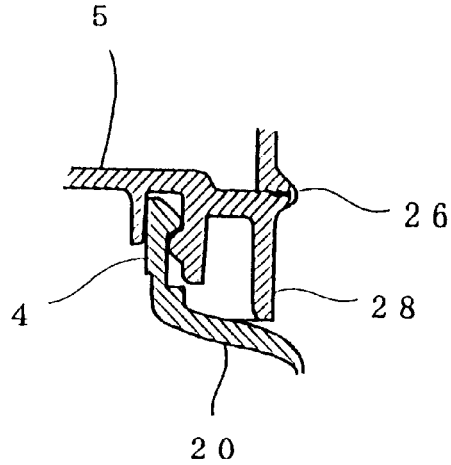
FIG. 17 is a view of the modified example of the means for engaging the cap member of the container shown in FIG. 14.

The FIG. 17 shows a modified example of the means for fixing the cap member 2, i.e. a pair of ridges for providing a mutual engagement, which are formed on the upper end of the outside of the neck portion 4 and the lower end of the inside of the first circumferential wall 28, in a way that the one of the ridges may forcibly ride over the other thereof.

Figure 19:
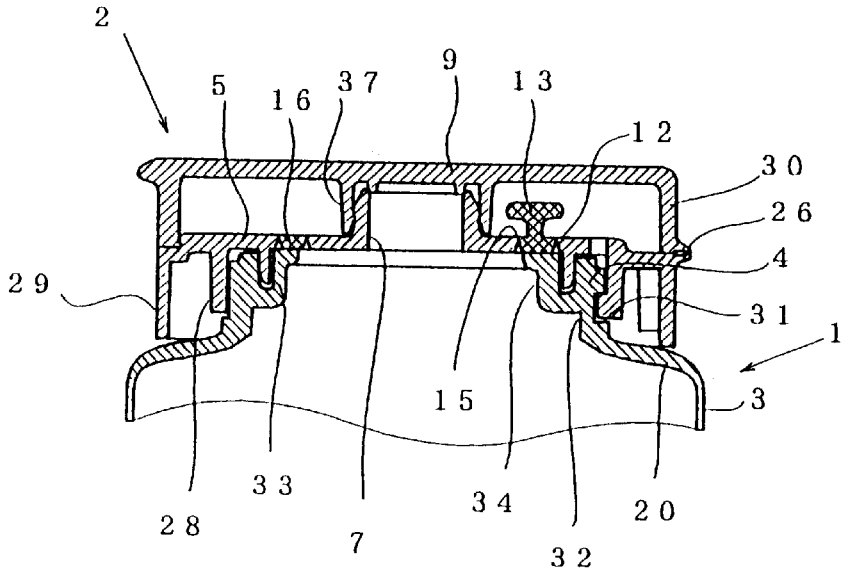
FIG. 19 is the view of the modified example of the other part of the container shown in FIG. 14.

The FIG. 19 shows a modified example of the construction of the neck portion 4. The neck portion has an inner cylinder 34 erecting from the inside of its lower part, spacing a small interval from the inside of its upper part. Outside the inner edge of the top face of the inner cylinder 34, the first breaking line is circumferentially formed on the top wall. The inner cylinder also has an outer surface which may preferably be smooth such that the user does not cut one's finger with a cut surface formed by removing the removable zone 16.

Figure 20:
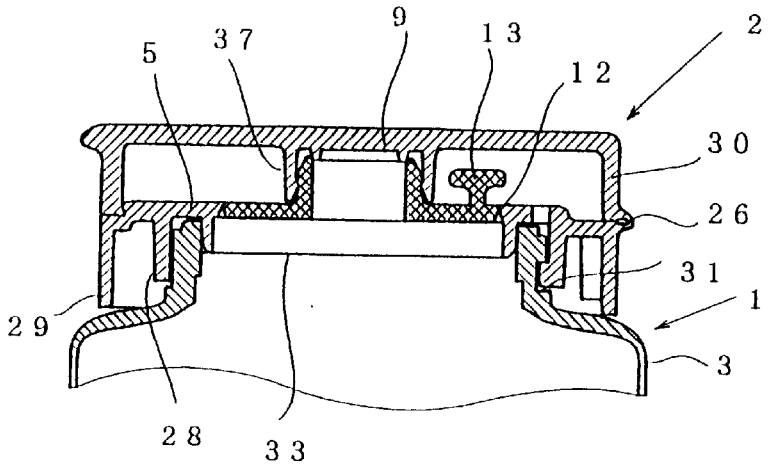
FIG. 20 is a sectional view of the container in the seventh embodiment of the present invention.
Figure 21:
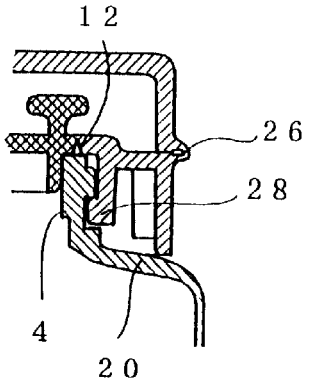
FIG. 21 is a sectional view of the modified example of the part of the container shown in FIG. 20.
Figure 22:
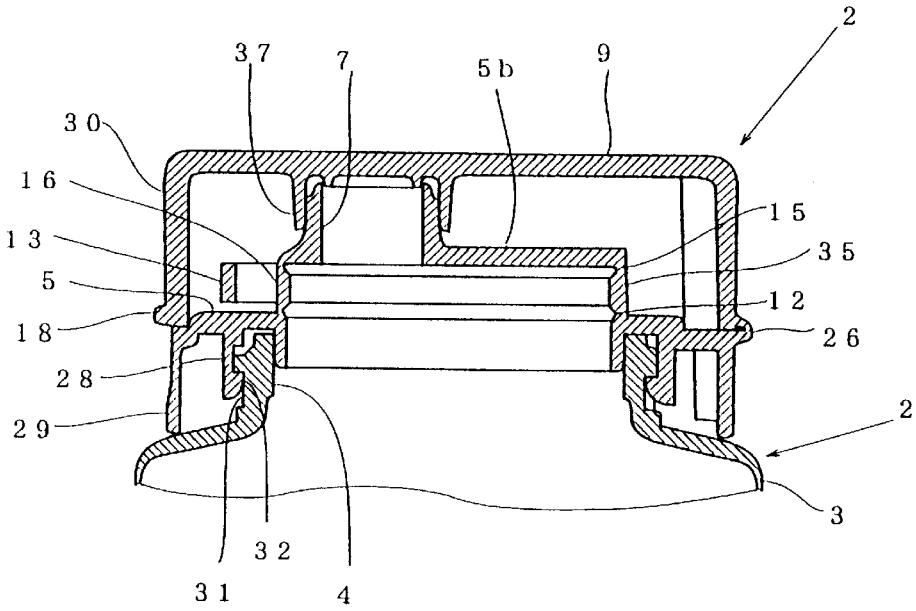
FIG. 22 is a vertical sectional view of the container in the eighth embodiment of the present invention.

The FIGS. 20 and 21 show the seventh embodiment of the present invention.

This embodiment is different from the sixth embodiment in that the second and third breaking lines shown therein are not provided. Only the first breaking line 12 is formed circumferentially on the top wall, while the top wall has a wall portion within the first breaking line including the nozzle cylinder 7 and the knob 13. The type of the synthetic resin used for forming said wall portion is different from that of the other portion of the top wall outside the first breaking line, such that the breaking line is defined by an interface in which the two type of synthetic resin meet each other. The first breaking line may be formed within the neck portion as mentioned above, but it may be formed above the neck portion in FIG. 21. The first breaking line may preferably be formed outside the neck portion, although it is not shown in the drawings.

FIGS. 22 to 25 show the eighth embodiment of the present invention.

In this embodiment, the top wall 5 for closing the top surface of the neck portion, is incorporate into the cap member separately from the tube member 1, as it is in the sixth embodiment. Moreover, the first circumferential wall 28 is depending from the underside of the top wall 5 and fitted on the outside of the neck portion 4, while the top wall has a wall portion which is-protruding outwardly from the first circumferential wall and connected at its rear part with a second circumferential wall 30 via a thin hinge 26. Said second circumferential wall is depending from the periphery of the cover plate 9.

Figure 24:
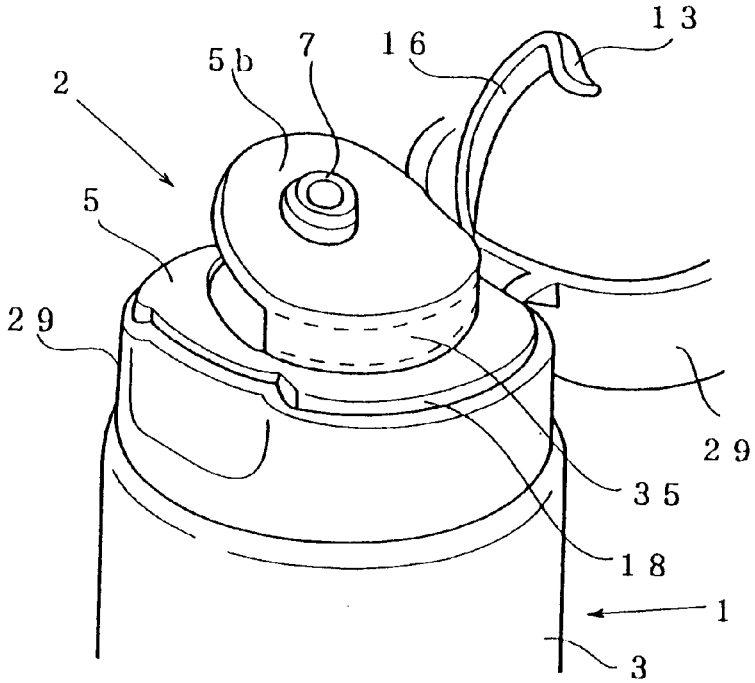
FIG. 24 is an explanation view of the container shown in FIG. 22 in a state in which a top plate is removed.

In this embodiment, however, the top wall 5 has a short cylinder 35 which is formed by raising a top wall portion **5*b* within the inner face of the neck portion into top-closed cylindrical shape. The nozzle cylinder 7 is erecting from a part of the top wall closing the top surface of the short cylinder. The first circumferential wall 28 is provided at the lower end of the inside thereof with the engagement projection 32, which is fitted into the recessed groove 31 circumferentially formed on the lower part of the neck portion at its outside, so as to fit or firmly fix the first circumferential wall on the neck portion. In this specification, the word "top wall" is not limited to something having a flat-plate shape, but includes any wall structure covering the top surface of the neck portion, such as a structure having a top closed circular wall protruding from the first circumferential wall through an inward flange, as shown in this embodiment. The first and second breaking lines 12 and 15, which are thin and lateral, are at the lower and upper ends of the short cylinder 35 respectively, so as to form a wall portion between the first and second breaking lines into the removable zone 16. The L-shaped knob 13 is protruded outwardly from the outer surface of the removable zone 16, and the third thin breaking line 17 for connecting the first and second breaking lines 12, 15 is vertically formed in the vicinity of the L-shaped knob 13, such that the first and second breaking lines 12 and 15 start to break from the third breaking line 17 as shown in FIG. 24 by pulling the knob 13** outwardly such that the top wall portion of the short cylinder is removed.

When the L-shaped knob is protruded upwardly from the upper surface of the top wall, the knob may be an obstacle for user to wipe off a possible stain attached around the nozzle cylinder for example. However, such an inconvenience does not happen in this embodiment, since the knob is protruded from the side surface of the short cylinder 35 such that a comfortable use is guaranteed. The leading portion of the L-shaped knob is protruded opposite to the third breaking line as it is in the first embodiment.

In the shown embodiment, the knob 13 is protruding from the front wall portion of the short cylinder 35, i.e., wall portion thereof which is opposite from the thin hinge. Owing to this structure, when an user grip the trunk portion of the container with its front face turning towards oneself, and open the cap by pushing the front wall portion of the circumferential cap with a finger, then the front wall portion having the knob turns to face towards the user. Therefore, it is easy to pick and pull the knob 13 to tear off the breaking line, since it is not necessary to change the manner of holding the trunk portion. Meanwhile, although it is not shown in the drawings, the knob 13 may be provided in the vicinity of the thin hinge apart from the front end of the top wall 5 as it is in the fifth embodiment, or more preferably in the rear wall portion of the short cylinder 35 facing the thin hinge. Owing to this structure, the knob 13 is prevented from being dashed a liquid, when the user incline the tube container towards the forward to discharge the liquid from the discharge port. Moreover, the knob 13 may be provided at either of the left or right side wall portions of the short cylinder 35 to prevent it from hindering the opening and closing operations of the the cover.

Figure 23:
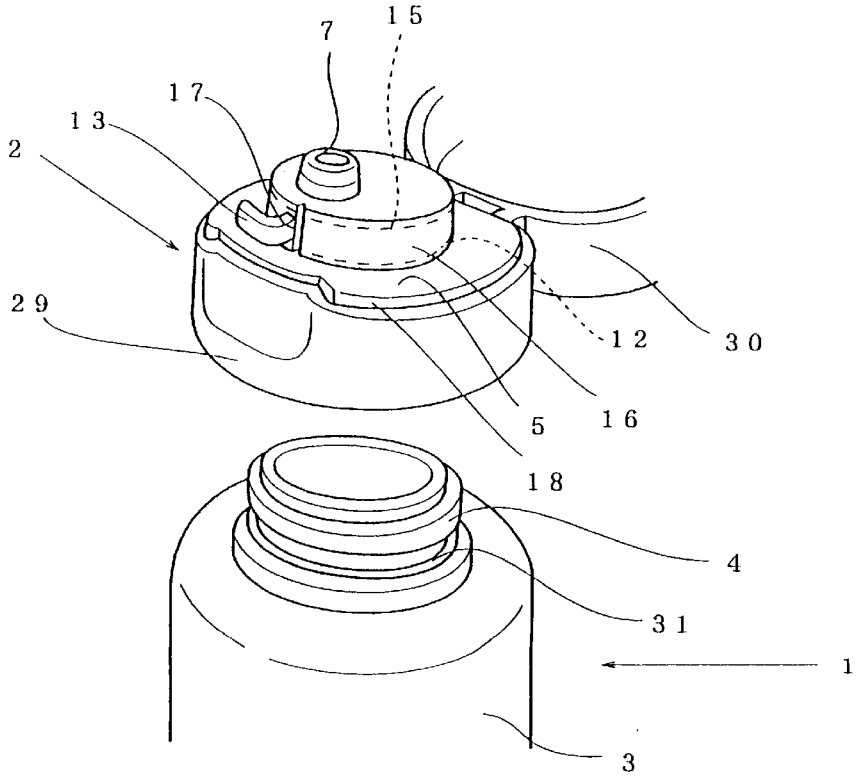
FIG. 23 is a perspective view of the container shown in FIG. 22 in a dissolved state.
Figure 25:
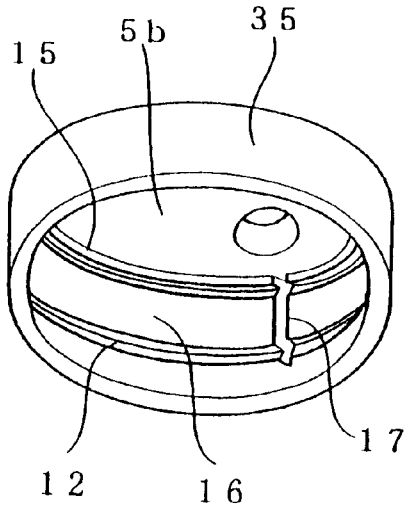
FIG. 25 is a perspective view of the modified example of the container shown in FIG. 22.
Figure 26:
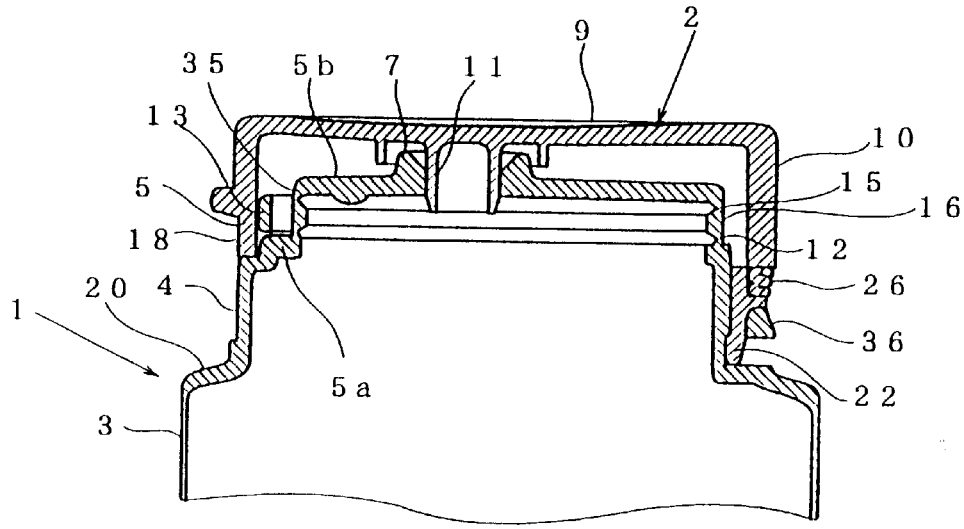
FIG. 26 is a vertical sectional view of the container in the ninth embodiment of the present invention.
Figure 27:
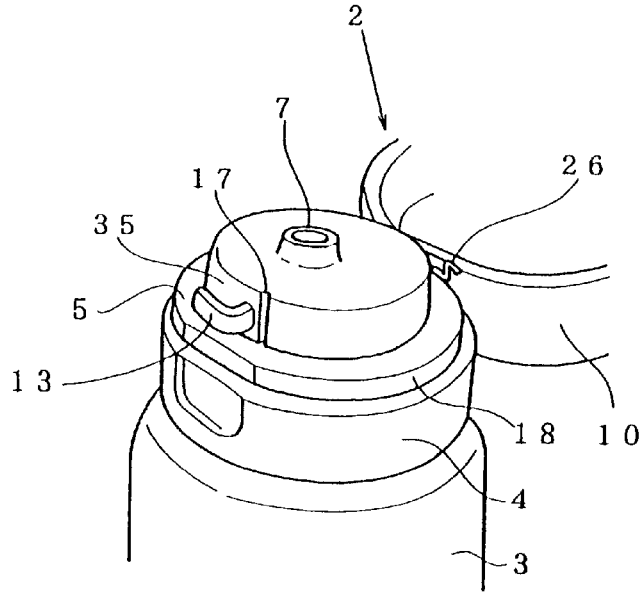
FIG. 27 is a perspective view of the container shown in FIG. 26 with a cover being opened.
Figure 28:
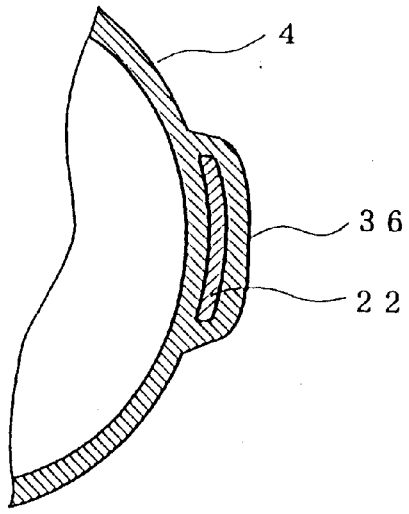
FIG. 28 is a lateral sectional view of the part of the container shown in FIG. 26.

Each of the first and second breaking lines is formed by cutting a V-shaped notch into the inside of the short cylinder as shown in FIG. 23, paying an attention to an aesthetic aspect of the container. The third breaking line 17 shown in FIG. 23 is formed by notching the outside of the short cylinder, but it may be formed by notching the inside of the same as shown in FIG. 25, as the first and second breaking lines are.

The upper end of the top wall 5 is formed into a small external diameter portion 18 for fitting air-tightly to the lower surface of the second circumferential wall 30, so as to prevent the contents from being dried and stiffen.

The FIGS. 26 to 29 show the ninth embodiment of the present invention.

Figure 29:
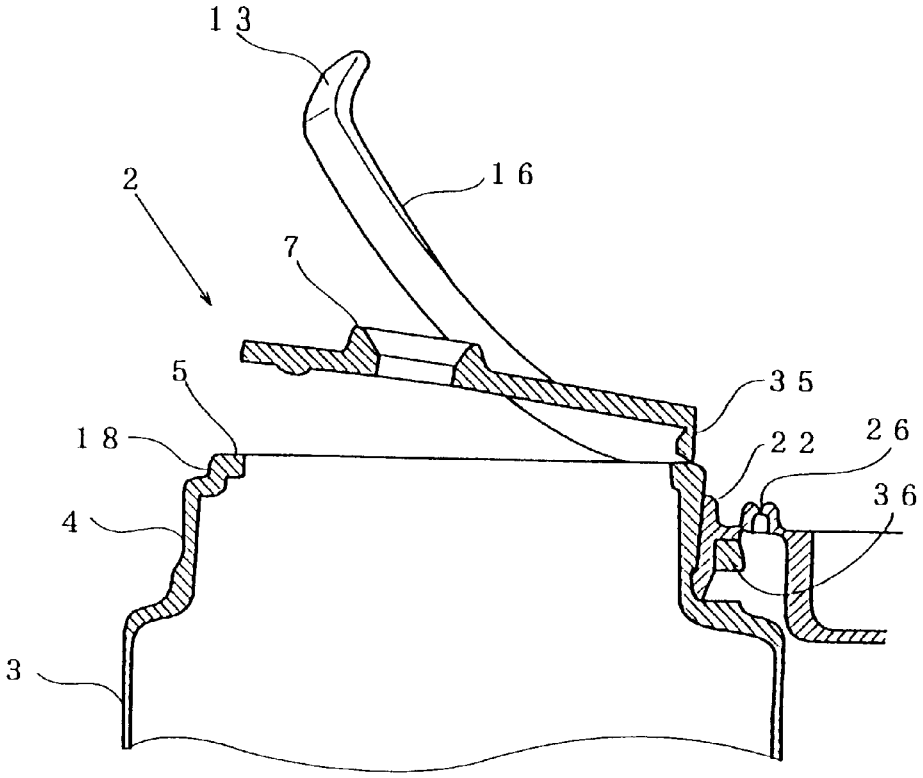
FIG. 29 is an explanation view of the container shown in FIG. 26 in a state a top wall is removed.
Figure 30:
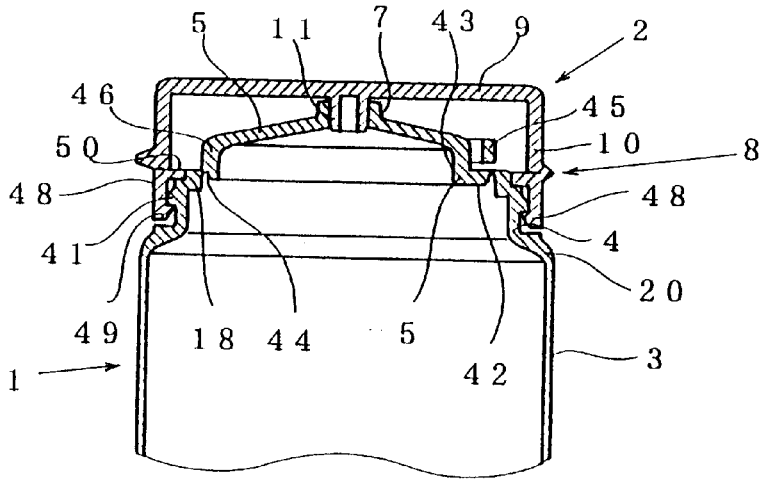
FIG. 30 is a vertical sectional view of the container in the tenth embodiment of the present invention.

In this embodiment, the construction of the short cylinder in the eighth embodiment is applied to a top wall which is integrally formed to the trunk portion of the tube member. Namely, the tube member 1 has a neck portion 4 erecting from the trunk portion 3 through the shoulder 20 and a top wall 5 for closing the upper surface of the neck portion, the said top wall consisting of a peripheral top wall portion 5*a* and a remainder thereof which is raised to form a top closed short cylinder 35. The short cylinder has the first, second, and third breaking lines and the knob 13, as it does in the eighth embodiment. The peripheral top wall portion is stepped at the outer edge of its upper surface to form a small external diameter portion 18. And also, the neck portion is provided at the back of its outer surface with a mounting portion 36 which is formed into a cylindrical or U-shaped configuration as shown in FIG. 29 elongated in a circumferential direction of the neck portion and has upper and lower opened surfaces.

Moreover, the cap member 2 has a circumferential cap wall 10 depending from the circumference of the cover plate 9 and being placed on the small external diameter portion 18. The respective back portions of the cover plate 9 and the circumferential cap wall 10 are protruded backward. A thrusting plate 22 is protruded from the back portion of the circumferential cap wall 10 through the thin hinge 26, with a lower portion of the thrusting plate 22 being fixed and fitted into the mounting portion 36 by inserting thereinto.

FIGS. 30 to 34 shows the tenth embodiment of the present invention.

This embodiment provides a tube container having a belt for tearing a separation part instead of the knob in the preceeding embodiments.

The container according to this embodiment has a synthetic resin made tube container 1 having an elastically squeezable trunk portion 3, from which a neck portion 4 is erecting through a shoulder 20. The width of the shown shoulder is small so as to form a wide-opened neck potion. The outside of the neck portion is formed to have a fitting ridge.

A top closed vertical cylinder 43 is erecting from the upper end of the neck portion through an inward flange 42. While, the top surface of the vertical cylinder 43 is closed by a top wall 5 having a discharge port 6.

The inward flange 42 has a separation part (or a separating portion) 44 for separating the vertical cylinder 43 from the neck portion 4. The separation part is defined by a thin breaking line which is formed by cutting a notch on the underside of the inward flange 42. The breaking line may be formed by notching an inverted V-shaped groove into the underside of the inward flange 42.

Figure 31:
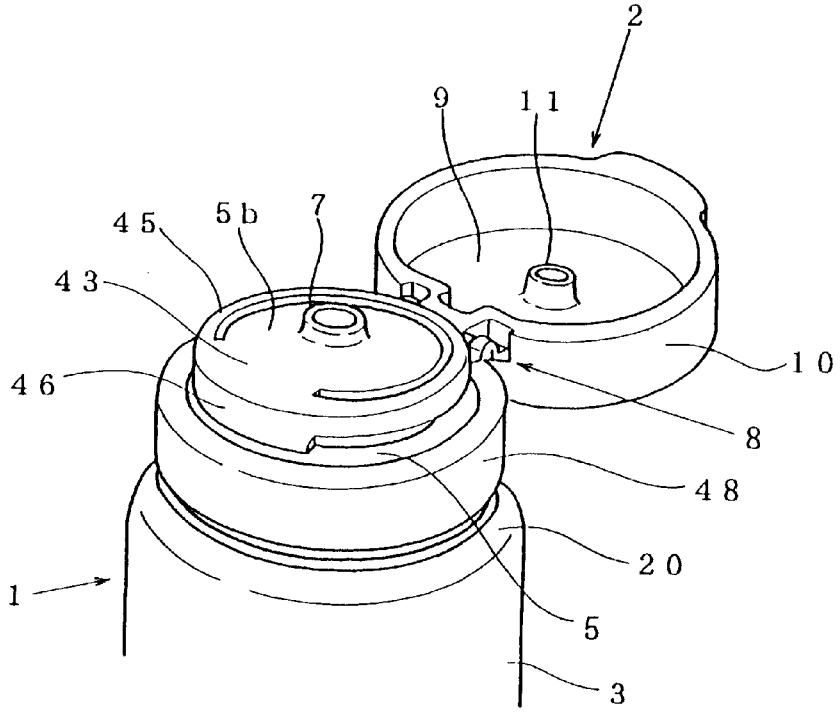
FIG. 31 is a perspective view of the container shown in FIG. 30 with a cover being opened.

A flexible belt 45 for tearing off the breaking line is attached to the vertical cylinder 43, including a part of the vertical cylinder in common as a common wall 46. The shown common wall is formed by the front part of the vertical wall. And the remainder of the belt is encircling the vertical cylinder 43 as shown in FIG. 31 spacing a constant interval from the vertical cylinder except the common wall. In this construction, the belt is incorporate into the tube member 1 close to the vertical cylinder 43 except the common wall. As a result, the belt does not conflict with a hand of the user holding the container, so that the belt is prevented from being a disturbance for handling the container during an usual period of use from the beginning of the use of the container to the removal of the top wall.

Numeral 2 designates a cap member, having a fixing cylinder 48 fitted on the outside of the neck portion, and a cover plate 9 from the circumference from which a circumferential cap wall 10 is depending. The circumferential cap wall is connected to the rear portion of the fixing cylinder through a three point hinge mechanism 8. In the shown embodiment, the fixing cylinder 48 is formed into a channel-like sectional shape by protruding second and third fitting ridges 49, 50 inwardly from the lower and upper ends of the fixing cylinder respectively. The fixing cylinder is firmly fitted onto the outside of the neck portion 4 by engaging the second fitting ridge 49 to the lower face of the first fitting ridge 41 and engaging the third fitting ridge 50 on the lower face of the small external diameter portion 18 respectively.

Figure 32:
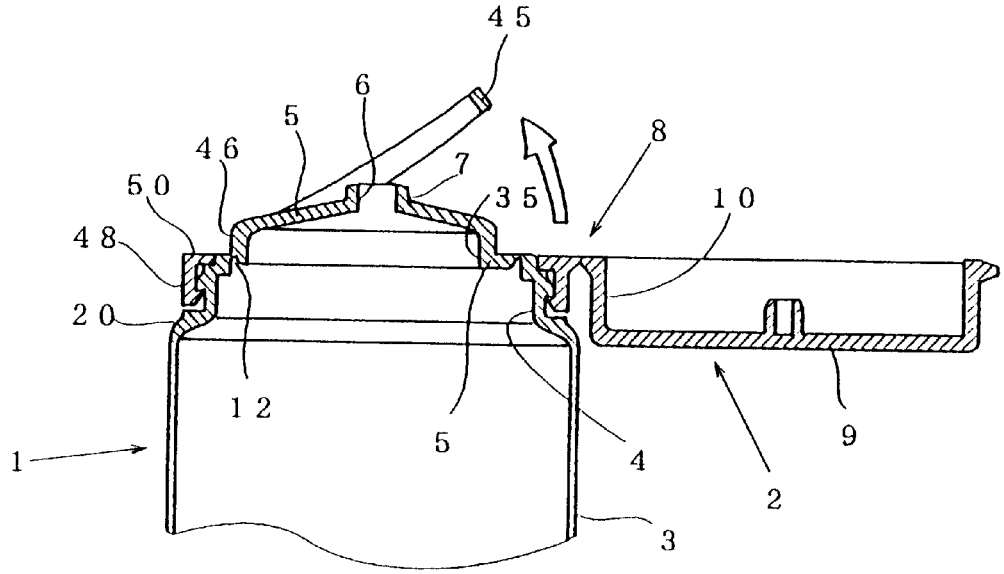
FIG. 32 is an explanation view of the container shown in FIG. 30 in a state of removing a top wall.
Figure 33:
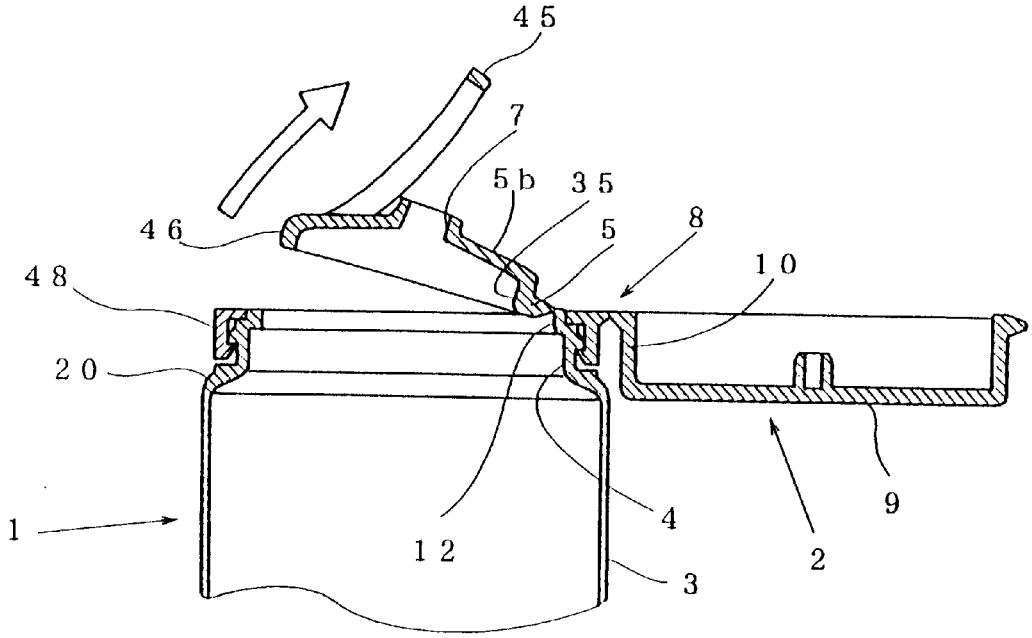
FIG. 33 is an explanation view of the container shown in FIG. 30 in another state of removing the top wall.
Figure 34:
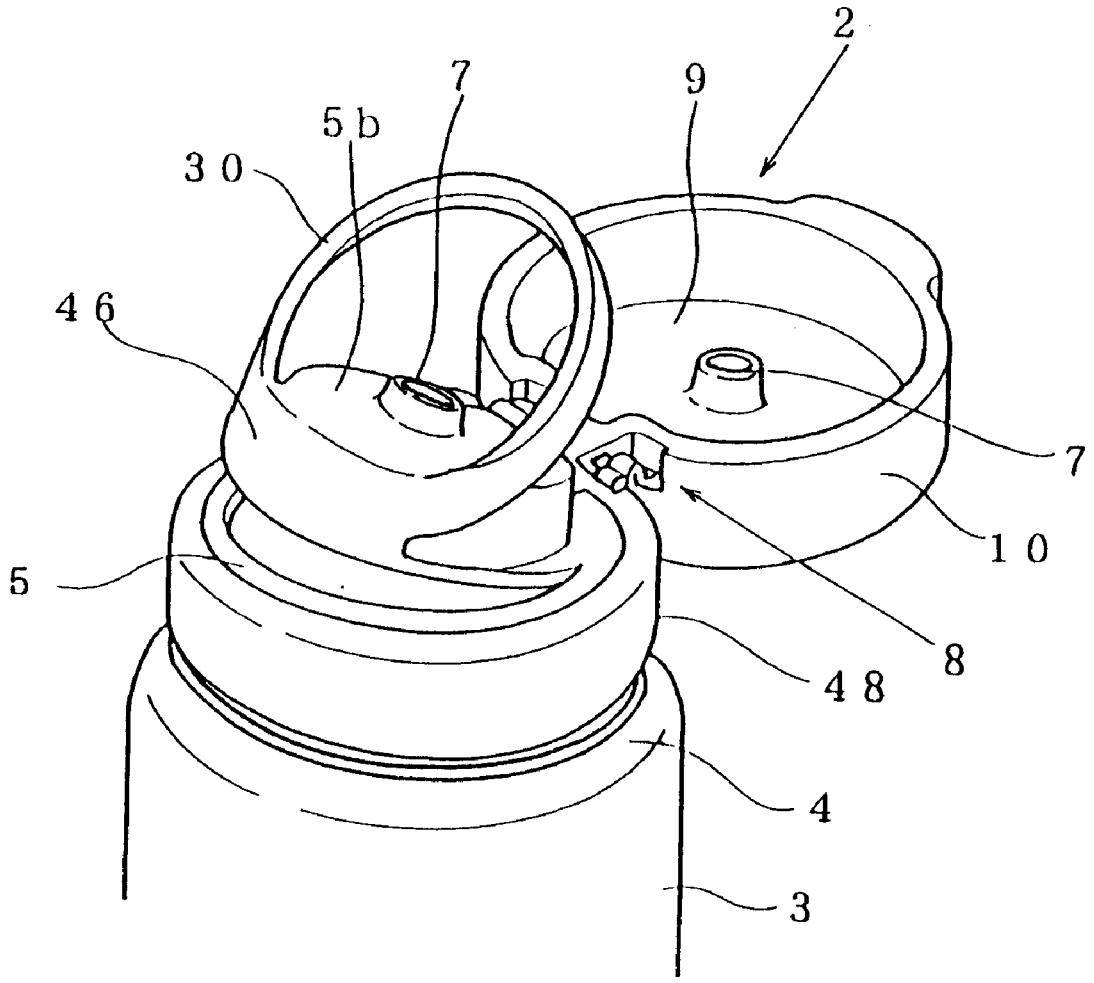
FIG. 34 is a perspective view of the container shown in FIG. 30 in a state a top wall is removed.
Figure 35:
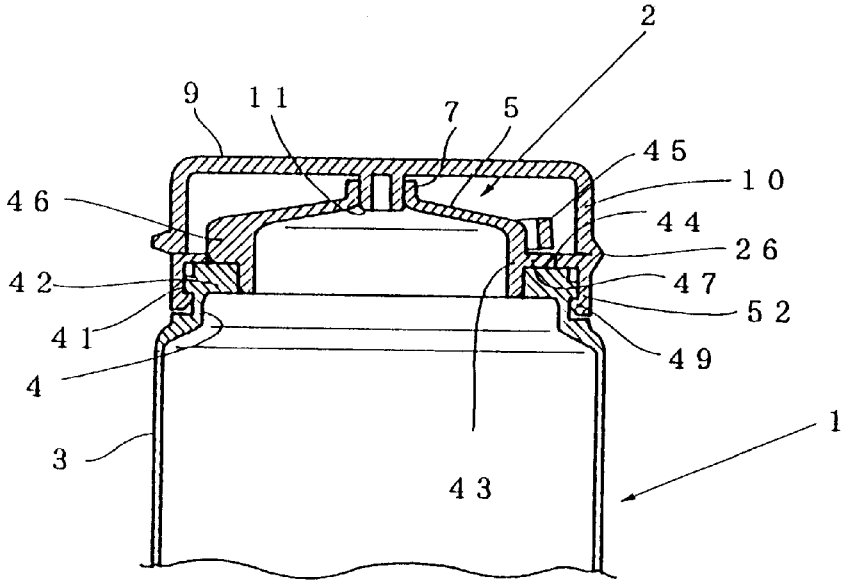
FIG. 35 is a vertical sectional view of the container in the eleventh embodiment of the present invention.

In this structure, the top wall 5 is removed by pinching the rear end portion of the belt, (i.e. the end portion of the belt opposite to the common wall 46) to the upper front in a direction of an arrow shown in FIG. 32, and by pulling the same to the upper back as shown in FIG. 33. In this way, the breaking line is broken from the front end thereof, such that the top wall 5 together with the vertical cylinder portion above the breaking line from the remainder of the same. After that, the contents can be taken out by inserting a finger or a spatula, etc into the neck portion.

The FIGS. 35 to 38, show the eleventh embodiment of the present invention.

The belt 45 for tearing the separation part is provided as a means for removing the top wall 5 in the present embodiment as it is in the tenth embodiment. However, the vertical cylinder 43 connected to the top wall is formed separately from the tube member. Hereafter, the explanation on the element which is the same to that of the tenth embodiment is omitted, using the same numeral thereto.

The tube member 1 is integrally formed to have a neck portion 4 erecting from a trunk portion 3, and a thick inward flange 42 protruding from the upper end of the neck portion 4. A first fitting ridge 41 is attached on the outside of the neck portion 4.

Moreover, the cap member 2 has a vertical cylinder 43 which is mounted in the neck portion 4, and the cover plate 9 integrally formed with the vertical cylinder.

The vertical cylinder 43 is defined by a cylindrical wall with a vertically middle portion, from which an outward flange 47 is protruded. The outward flange is placed on the upper end surface of the neck portion 4 and the upper side of the inward flange 42. And the lower half of the vertical cylinder is fitted water-tightly into the the inside of the inward flange.

The upper surface of the vertical cylinder is closed by the top wall 5. The shown top wall is defined by a tapering wall which is slanting inwardly upward from the upper end of the vertical cylinder 43 and terminating in a nozzle cylinder 7 at the upper end thereof.

A mounting cylinder 52 is depending from the outer edge of the outward flange 47, and fitted on the outside of the neck portion 4. A second fitting ridge 49 is provided at the lower end of the mounting cylinder 52 and engaged with the underside of the first fitting ridge. separation part 44 is defined by a thin breaking line which is circumferentially formed on the inner circumference of the outward flange 47 by notching an inverted V-shaped groove thereto, such that the vertical cylinder 43 may be separated from the mounting cylinder 52. The outward flange 47 is connected at the rear portion of its circumference to a circumferential cap wall depending from the outer edge of the cover plate 9.

The upper half of the vertical cylinder 43 has a flexible belt 45 for tearing the breaking line. The belt is merging into a part of the vertical cylinder 43 (the front part of the vertical cylinder in the shown embodiment), which is formed into a thick common wall 46, while the remainder of the belt is protruding from the both sides of the common wall and encircling the portion of the vertical cylinder except the common wall as similar to the eleventh embodiment.

Figure 36:
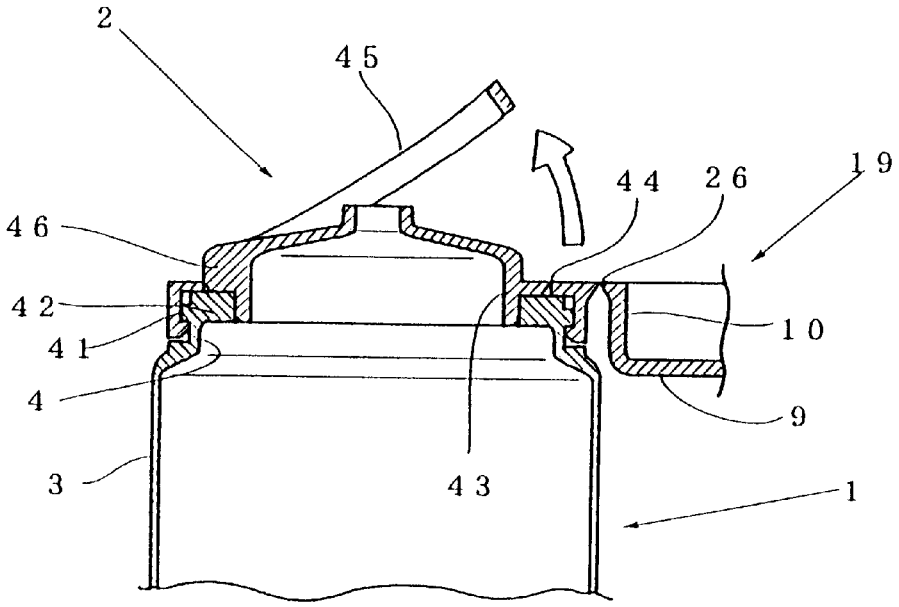
FIG. 36 is an explanation view of the container shown in FIG. 35 in a state of removing a top wall.
Figure 37:
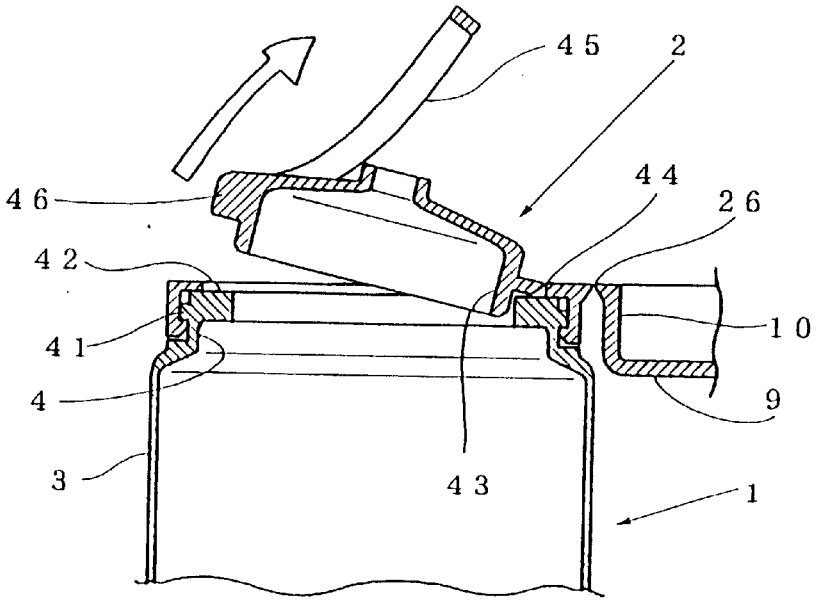
FIG. 37 is an explanation view of the container shown in FIG. 35 in another state of removing the top wall.
Figure 38:
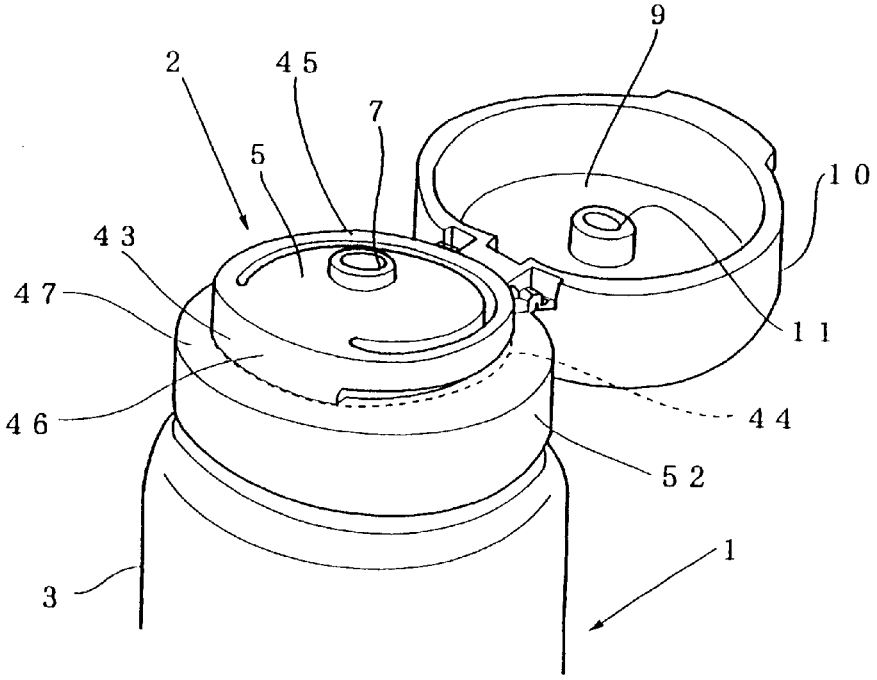
FIG. 38 is a perspective view of the container shown in FIG. 35 with a cover being opened.
Figure 39:
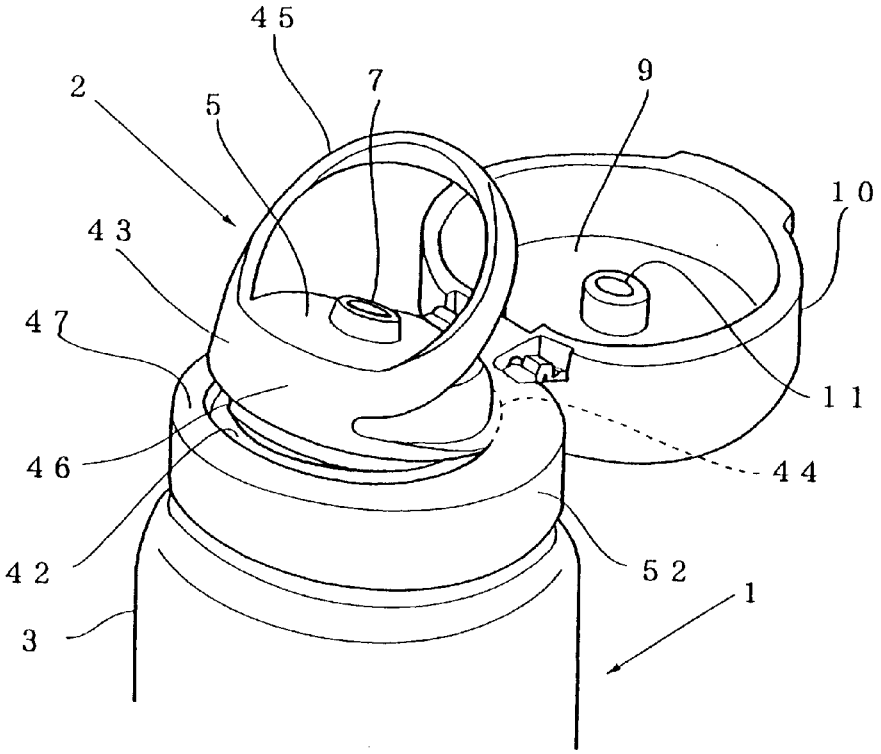
FIG. 39 is a perspective view of the container shown in FIG. 35 in a state of removing a top wall.

The upper face of the neck portion can be opened by pinching the belt 45 upwardly forward as shown in FIG. 36 and then pulling the same upwardly backward as shown in FIG. 37, such that the breaking line on the outward flange is broken and the lower half of the vertical cylinder 43 is pulled out from the neck portion 4.

FIGS. 40 to 44 show the twelfth embodiment of the present invention.

In this embodiment, a separation part 44 is defined by a separation surface (or a peeling off surface) which is formed by a surface at which the vertical cylinder and the neck portion contact each other instead of the breaking lines in the tenth and eleventh embodiments.

Also in this embodiment, the tube member 1 has the neck portion 4 erecting from the trunk portion 3 through the shoulder 20. A fitting short cylinder 54 is erecting from the neck portion 4 through an inward projection 53 in the shown embodiment. A step portion for engaging with a later-described inward flanged wall is formed by the outer side of the fitting short cylinder and the upper face of the the neck portion 4.

The cap member 2 has the vertical cylinder 43 in the eleventh embodiment, which is formed separately from the cover plate 9.

The vertical cylinder 43 is defined by a cylindrical wall with a vertically middle portion, from which an outward flange 47 is protruded. The outward flange is placed on the fitting short cylinder 54. And the lower portion 43*a* of the vertical cylinder is fitted into the inside of the inward projection 53, while an engagement protrusion 55 which is provided at the lower end of the vertical cylinder 43 is engaged with the underside of the inward projection 53, so as to fix the vertical cylinder 43 to the neck portion. The under side of the outward flange 47 is adhered to the upper side of the fitting short cylinder 54 with an adhesion strength which enables to separate these two surfaces by pulling up the belt 45, such that the separation surface is formed by the two surfaces as the separation part. The adhesion may be executed by circumferentially spaced several spots on the two surfaces to be stuck. For example, it may be carried out by contacting several ridges (unshown) raised on one surface to the other surface, and by melting the ridges by means of a supersonic adhesion.

The vertical cylinder 43 has an upper surface closed by the top wall 5 with the nozzle cylinder 7. Except the front portions of the vertical cylinder and the top wall, there is formed a belt-housing recess 56 at the outer circumference of the top wall as well as the upper half portion of the vertical cylinder above the outward flange 47. The belt-housing recess is opened upward and laterally outward. In the construction of the vertical cylinder, the upper half portion has a front part which is merged into a belt 45 to form a common wall 46, from the both sides of which the remainder of the belt is protruding and encircling the outside of the upper half portion except the common wall.

A circumferential cap wall 10 is depending from the circumference of the cover plate 9, and connected through the thin hinge 26 to a fixing cylinder 48 which is fitted firmly on the outside of the neck portion. The fixing cylinder 48 has a second fitting ridge 49 and an inward flanged wall 57 in place of the the third fitting ridge. The second fitting ridge 49 is protruding inward from the lower end of the fixing cylinder and engaging with the underside of the first fitting ridge 41, while the inward flanged wall 57 is protruding inward from the upper end of the fixing cylinder and engaging with the upper end surface of neck portion.

Figure 40:
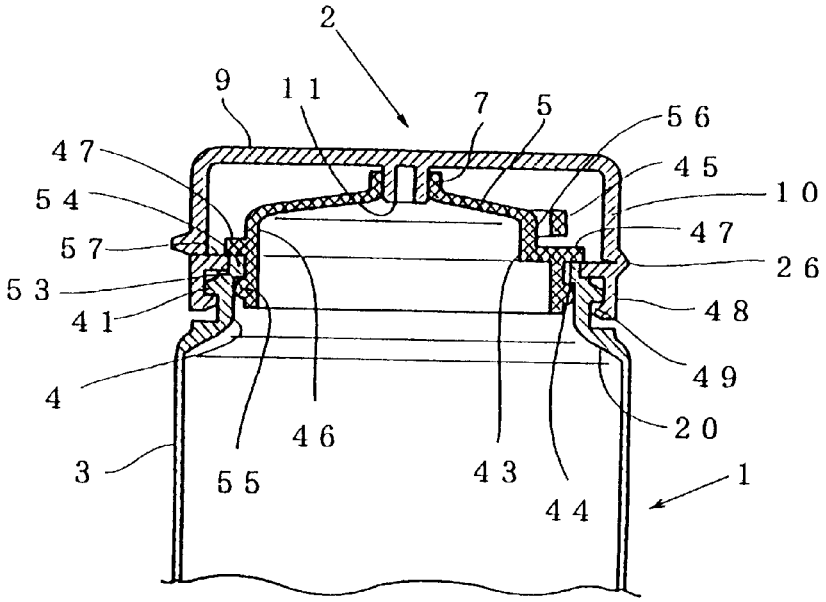
FIG. 40 is a vertical sectional view of the container in the twelfth embodiment of the present invention.
Figure 41:
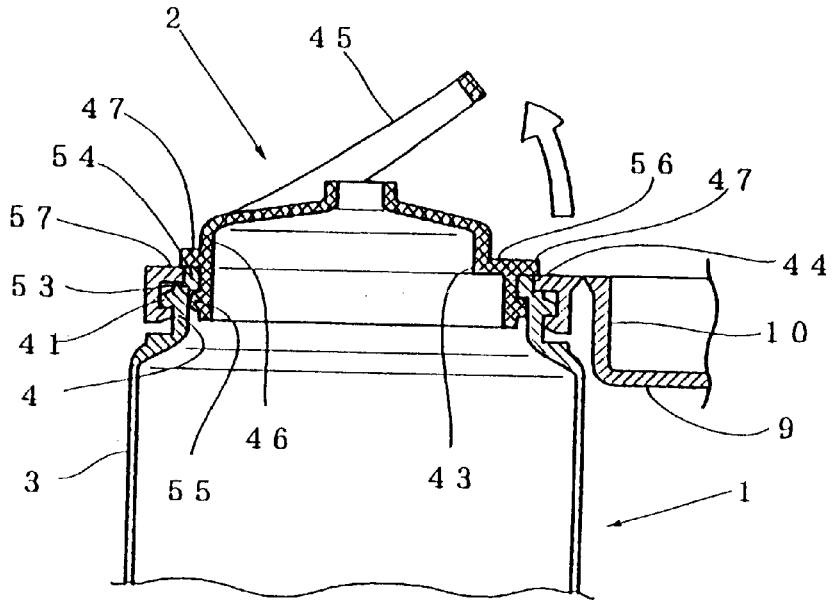
FIG. 41 is an explanation view of the container shown in FIG. 40 in a state of removing a top wall.
Figure 42:
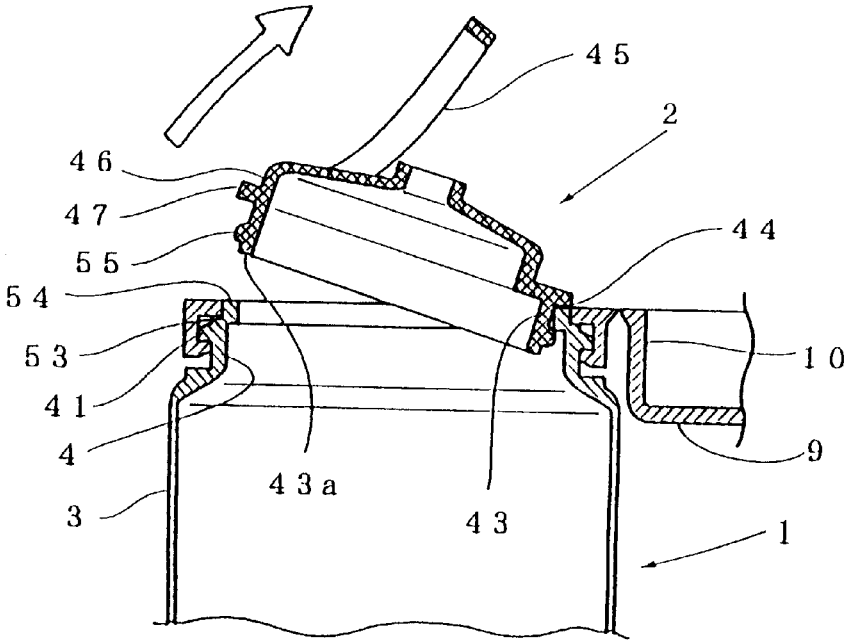
FIG. 42 is an explanation view of the container shown in FIG. 40 in another state of removing the top wall.
Figure 43:
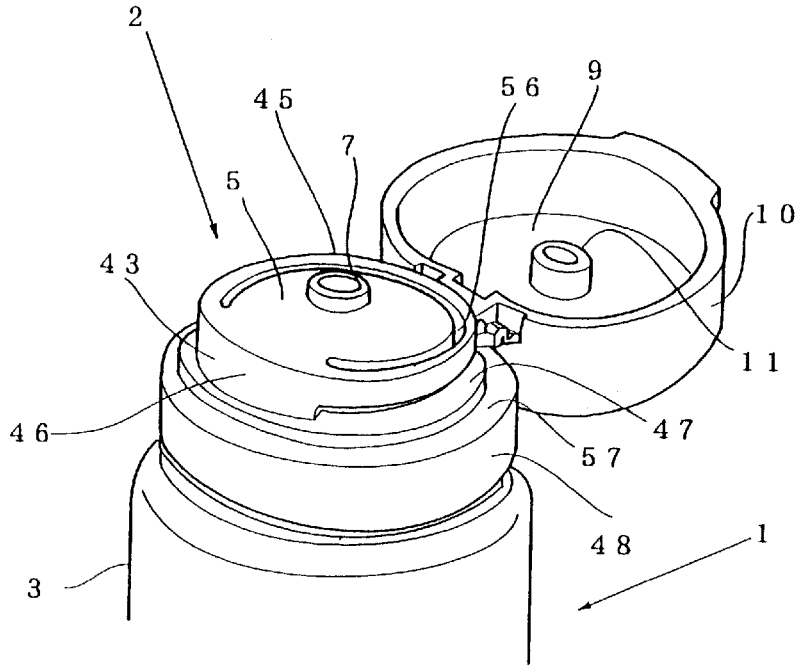
FIG. 43 is a perspective view of the container shown in FIG. 40 with a cover being opened.
Figure 44:
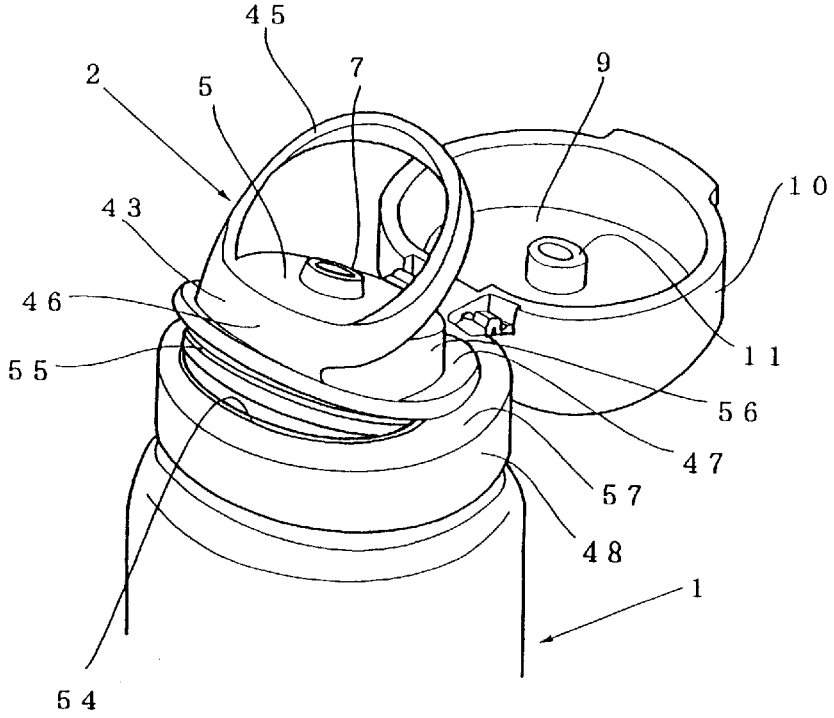
FIG. 44 is a perspective view of the container shown in FIG. 40 in a state of removing a top wall.

In this construction, when the amount of the contents become a little, the upper surface of the neck portion 4 can be opened by lifting up the cover plate 9 from the state shown in FIG. 40, and by pinching and pulling the belt 45 as shown in FIG. 41 and 42, such that the separation surface is peeled off and the vertical cylinder 43 is removed upwardly. After that, the contents can be taken out by inserting the finger for example into the opening of the neck portion.

FIGS. 45 to 49 show the thirteenth embodiment of the present invention.

This embodiment proposes a structure for mounting the vertical cylinder, which is different from the structure shown in the twelfth embodiment. The explanation on the element which is the same to that of the previous embodiment is omitted by using the same numeral.

The container in accordance with this embodiment does not have the inward projection for placing the outward flange of the vertical cylinder. In place of it, an inward flanged wall 57 for placing the outward flange is protruding inward from the upper end of the fixing cylinder 48 and has an outer circumferential portion placed on the top of the neck portion.

The lower surface of the outward flange and the upper surface of the inward flanged wall are welded to form an separation surface as a separation part 44 for separating the neck portion 4 and the vertical cylinder 43.

Figure 45:
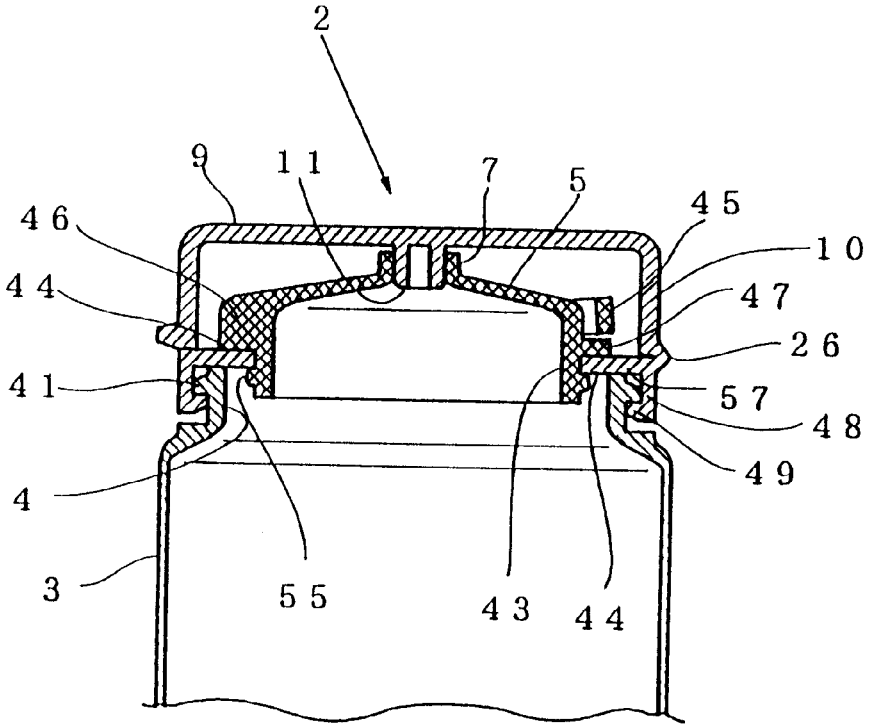
FIG. 45 is a vertical sectional view of the container in the thirteenth embodiment of the present invention.
Figure 46:
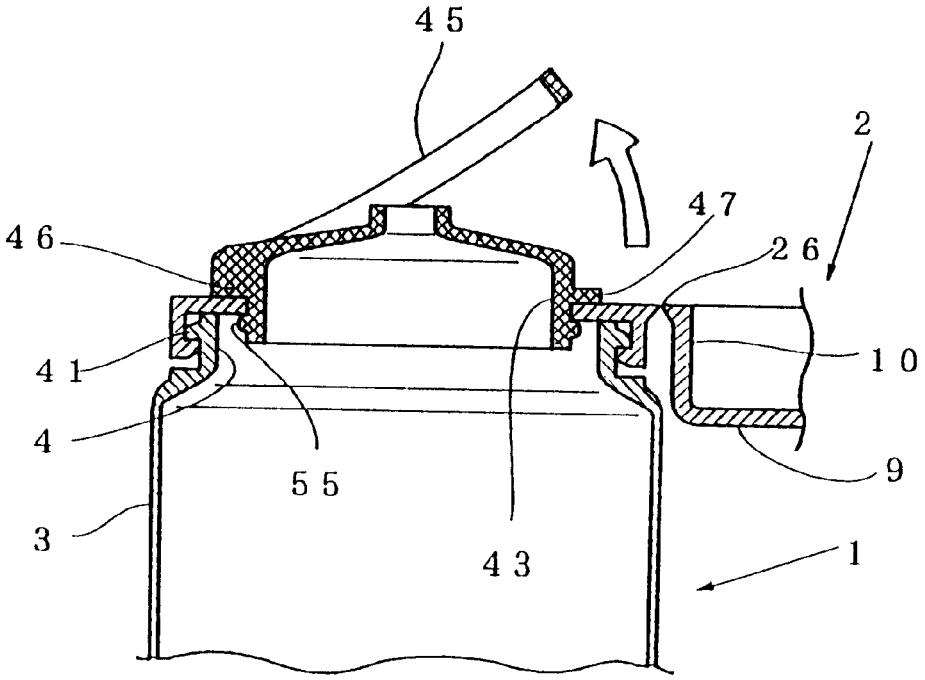
FIG. 46 is an explanation view of the container shown in FIG. 45 in a state of removing a top wall.
Figure 47:
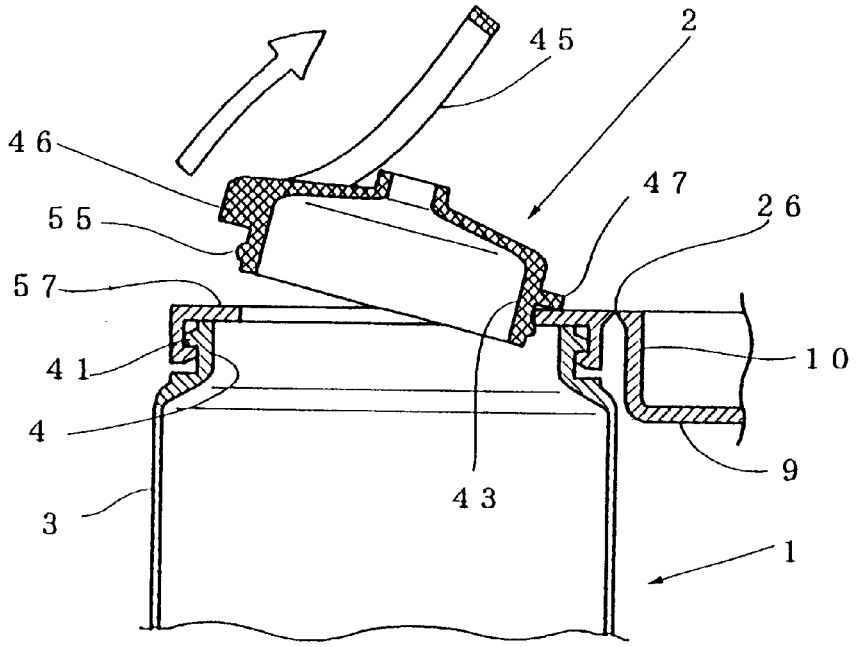
FIG. 47 is an explanation view of the container shown in FIG. 45 in another state of removing the top wall.
Figure 48:
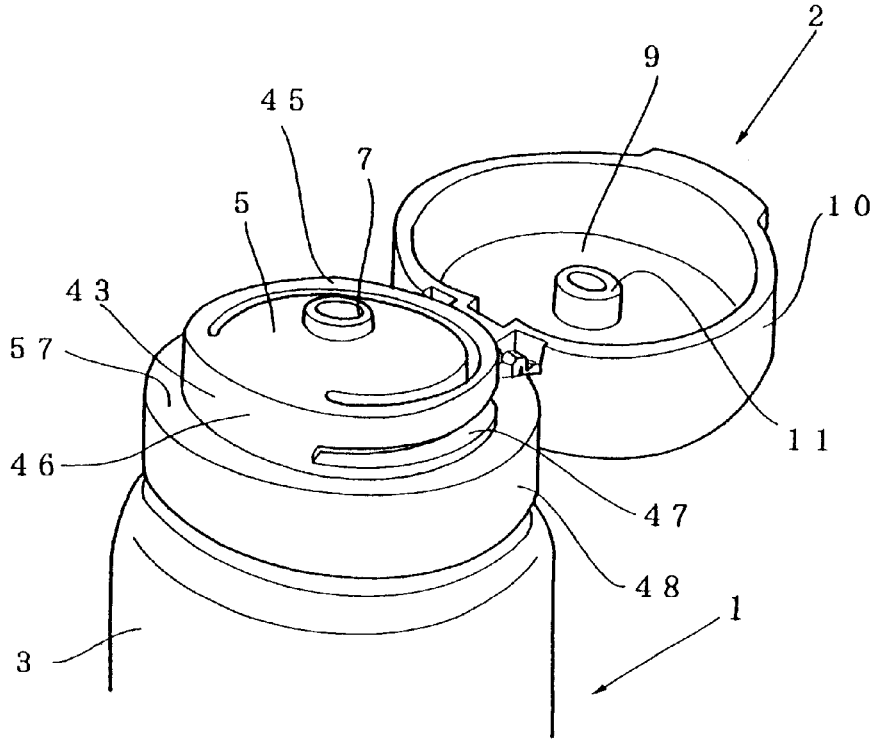
FIG. 48 is a perspective view of the container shown in FIG. 45 with a cover being opened.
Figure 49:
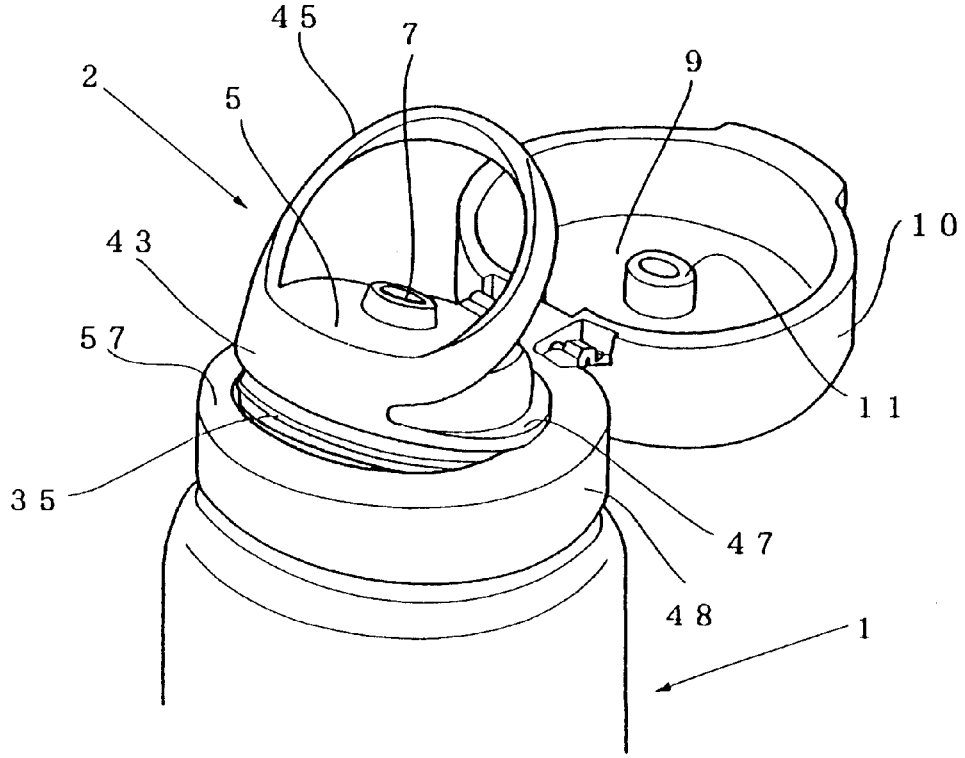
FIG. 49 is a perspective view of the container shown in FIG. 45 in a state of removing a top wall.

In this construction, the separation surface can be peeled off to open the neck portion by operations generally identical to those in the twelfth embodiment as shown in FIGS. 45 to 47.

Although the best modes of the present inventions are explained here, but it is to be understood the mode for carrying out the present invention may be changed without departing from the spirit of the invention.

What is claimed is:

1. A synthetic resin made tube container comprising:

a tube member (1) having a trunk portion (3) which is elastically squeezable, and a wide-mouthed neck portion (4) extending upwardly from the trunk portion (3);

a top wall (5) closing a top surface of the neck portion (4) and having a discharge port (6), said top wall (5) also having a peripheral portion connected to a top end of the neck portion (4); and a cover plate (9) which is connected to the neck portion by a hinge to the neck portion (4) and having a plug (11) for closing the discharge port (6), said plug depending from an underside of the cover plate (9), wherein the top wall (5) has a first breaking line (12) which is formed within the peripheral portion of the top wall (5), and a knob (13) for tearing the first breaking line (12), and said knob (13) is formed on the top wall (5) within the first breaking line (12).

2. A synthetic resin made tube container according to claim 1, wherein the trunk portion (3) has an upper end portion which is integrally merging into a lower end portion of the neck portion (4), an upper end portion of the neck portion (4) is integrally merging into the peripheral portion of the top wall (5) and the cover plate (9) is attached onto an upper part of the neck portion (4) through the hinge.

3. A synthetic resin made tube container according to claim 1, wherein the top end of the neck portion (4) is integrally merging into the peripheral portion of the top wall (5), said neck portion (4) has a fitting hole (21) which is provided on an outer circumferential portion of the neck portion, with the cover plate (9) connected to a thrusting plate (22) through the hinge, and said thrusting plate is fitted into the fitting hole (21).

4. A synthetic resin made tube container according to claim 1, wherein the top of the neck portion (4) is integrally merging into the peripheral portion of the top wall (5), said neck portion (4) has an annular fitting hole (21) which is provided on an outer circumferential portion of the neck portion, with the cover plate (9) connected to an annular thrusting plate (22) through the hinge, and said thrusting plate is fitted into the fitting hole (21).

5. A synthetic resin made tube container according to claim 1, further comprising:

a first circumferential wall (28);

a second circumferential wall (30); and an auxiliary circumferential wall (29), wherein said first circumferential wall (28) is depending from a lower surface of the top wall so as to be located outwardly of the first breaking line (12), and fitted on an outside of the neck portion (4), said auxiliary circumferential wall (29) is depending from an circumferential ridge of the top wall (5) and, said second circumferential wall (30) is depending from a circumference of the cover plate (9) and connected to a part of the auxiliary circumferential wall through the hinge.

6. A synthetic resin made tube container according to claim 1, wherein the first breaking line (12) is defined by a thin breaking line, the top wall (5) comprises a thin-made, second breaking line (15) which is circumferentially made within the first breaking line (12), and spaced at a constant interval from the first breaking line such that the knob (13) is provided on a removable zone (16) which is formed by a portion of the top wall between the first and second breaking lines and the top wall (5) further comprises a thin-made, third breaking line (17) extending across the removable zone (16) in a vicinity of the knob (13).

7. A synthetic resin made tube container according to claim 1 wherein the top wall (5) has a center portion which is made of one type of synthetic resin and the peripheral portion of the top wall (5) is made of another type of synthetic resin, such that the first breaking line (12) is defined by an interface where the two different types of synthetic resin meet to merge with each other.

8. A synthetic resin made tube container according to claim 1, wherein the top wall (5) also comprises a second breaking line (15) which is circumferentially made within the first breaking line (12) and spaced at a constant interval from the first breaking line such that the knob (13) is provided on a removable zone (16) which is formed by a portion of the top wall (5) between the first and second breaking lines, and said removable zone (16) is made of one type of synthetic resin with a rest of the top wall (5) made of another type of synthetic resin, such that each of the first and second breaking lines is defined by an interface in which the two different types of synthetic resin meet to merge with each other.

9. A synthetic resin made tube container according to claim 1, wherein a first circumferential wall (28) is depending from the peripheral portion of the top wall (5) and fitted on an outside of the neck portion (4), with the cover plate (9) connected to an outer ridge of the top wall (5) through the hinge, the top wall (5) has, within an inside of the neck portion (4), a wall portion which is formed into a top-closed, short cylinder (35), the first breaking line (12) is formed on a lower end of the short cylinder (35) and a second breaking line (15) is formed on an upper end of the short cylinder, with the knob (13) provided on an outer surface of a removable zone (16) which is formed by a cylindrical wall portion between the first and second breaking lines, and a third breaking line (17) for connecting the first and second breaking lines (12), (15) is formed in a vicinity of the knob (13).

10. A synthetic resin made tube container according to claim 1, wherein the top wall (5) has a center portion which is formed into a top-closed, short cylinder (35), the first breaking line(12) is formed on a lower end of the short cylinder (35) and a second breaking line (15) is formed on an upper end of the short cylinder, with the knob (13) provided on an outer surface of a removable zone (16) which is formed by a cylindrical wall portion between the first and second breaking lines a third breaking line (17) for connecting the first and second breaking lines (12), (15) is formed in a vicinity of the knob (13), said neck portion (4) has a fitting hole (21) which is provided on an outer circumferential portion of the neck portion, with the cover plate (9) connected to a thrusting plate (22) through the hinge, and said thrusting plate is fitted into the fitting hole (21).

11. A synthetic resin made tube container according to claim 1, wherein said cover plate (9) is connected to the neck portion (4) through the hinge, with the knob (13) attached on the top wall (5) in a neighborhood of the hinge.

12. A synthetic resin made tube container comprising:

a tube member (1) having a trunk portion (3), and a wide-mouthed neck portion (4) extending upwardly from the trunk portion (3);

a vertical cylinder (43) extending upwardly from the neck portion (4), and having a top wall (5) with a discharge port (6), said top wall closing a top face of the vertical cylinder (43); and a cover plate (9) which is connected to the neck portion by a hinge to the neck portion (4) and having a plug (11) for closing the discharge port (6), said plug depending from a lower side of the cover plate (9), wherein said vertical cylinder (43) has a lower part which is jointed to said neck portion (4) by fixing or merging, while a separation part (44) for departing an upper part of the vertical cylinder (43) is formed at a joint zone through which the neck portion (4) and the lower part of the vertical cylinder (43) are connected and a flexible, belt (45) for tearing the separation part (44) is provided to the vertical cylinder (43), the belt is integrally merged into a part of the vertical cylinder (43) above the separation part (44) to form a common wall (46) which is held by the belt and the vertical cylinder in common, with a rest of the belt (45) protruding from the common wall (46) and encircling the vertical cylinder (43) except the common wall (46).

13. A synthetic resin made tube container according to claim 12, wherein said vertical cylinder (43) is extending upwardly from the neck portion (4) through an inward flange (42), in which a breaking line is formed as the separation part (11), and the cover plate (9) is protruded through the hinge from a upper part of a mounting cylinder (52) fitted on an outside of the neck portion (4).

14. A synthetic resin made tube container according to claim 12, wherein the vertical cylinder (43) is provided with an outward flange (47), and a mounting cylinder (52) to be fitted on the neck portion (4) is depending from a circumferential underside portion of the outward flange (47), a breaking line is provided as the separation portion (44) in the outward flange (47) within the mounting cylinder, and the cover plate (9) is connected through the hinge to an outer circumferential portion of the outward flange (47).

15. A synthetic resin made tube container according to claim 12, wherein the vertical cylinder (43) is provided with an outward flange (47) which is placed on the neck portion (4), a underside of the outward flange (47) and an upper side of the neck portion (4) are separably adhered with each other to form the separation part (44), and the cover plate (9) is protruded through the hinge from a upper part of a mounting cylinder (52) fitted on an outside of the neck portion (4).

* * * * *